US011174631B2

(12) United States Patent
Porter

(10) Patent No.: US 11,174,631 B2
(45) Date of Patent: Nov. 16, 2021

(54) ADJUSTABLE CONCRETE ANCHOR TRACK

(71) Applicant: J&D GROUP, INC., Rigby, ID (US)

(72) Inventor: David B. Porter, Rigby, ID (US)

(73) Assignee: J&D GROUP, INC., Rigby, ID (US)

( * ) Notice: Subject to any disclaimer, the term of this patent is extended or adjusted under 35 U.S.C. 154(b) by 0 days.

(21) Appl. No.: 16/692,987

(22) Filed: Nov. 22, 2019

(65) Prior Publication Data

US 2020/0165812 A1 May 28, 2020

Related U.S. Application Data

(60) Provisional application No. 62/771,269, filed on Nov. 26, 2018.

(51) Int. Cl.
*E04B 1/41* (2006.01)

(52) U.S. Cl.
CPC ..... *E04B 1/4107* (2013.01)

(58) Field of Classification Search
CPC ..... E04B 1/4107; E04B 1/41; E04B 1/4114; E04B 1/4128; E04B 1/4135; E04B 2001/4192; E04B 2001/2684; E04B 2/707; E04G 21/185
See application file for complete search history.

(56) References Cited

U.S. PATENT DOCUMENTS 2,052,914 A 9/1936 Williams
2,108,107 A * 2/1938 De Wees ..... E04B 1/4107 52/701
2,954,647 A * 10/1960 Hsiang ..... E04B 1/4157 52/707
3,715,851 A * 2/1973 Bennett ..... F16B 35/00 52/707
3,960,356 A 6/1976 Adams
4,261,544 A 4/1981 Addison
5,240,224 A 8/1993 Adams
5,623,804 A * 4/1997 Kelly ..... E04B 1/4107 52/704
5,625,993 A * 5/1997 Kelly ..... E04B 1/4107 52/506.05
5,836,132 A 11/1998 Weathersby
2005/0252123 A1 11/2005 Colonias
2007/0039281 A1* 2/2007 Zambelli ..... E04B 1/4107 52/710
2009/0223165 A1 9/2009 Griffin, Jr.
2011/0308183 A1 12/2011 Asada et al.
(Continued)

OTHER PUBLICATIONS

International Search Report and Written Opinion, dated Feb. 19, 2020, received in International Application No. PCT/US19/63109.

*Primary Examiner* — Theodore V Adamos
(74) *Attorney, Agent, or Firm* — Davis Wright Tremain LLP; Heather M. Colburn

(57) ABSTRACT

An anchor track for use with a holdown anchor and an anchor assembly. The anchor track has an upwardly opening channel, a first end, and a second end. The anchor assembly is slidable within the upwardly opening channel between the first and second ends to a desired position when the anchor track is at least partially embedded in concrete. The anchor assembly extends upwardly from inside the upwardly opening channel to the holdown anchor and is couplable to the holdown anchor when the anchor assembly is positioned adjacent to the holdown anchor.

24 Claims, 18 Drawing Sheets

(56) References Cited

U.S. PATENT DOCUMENTS

| | | | | |
|---|---|---|---|---|
| 2013/0145720 | A1* | 6/2013 | Heudorfer | E04B 1/4107 52/710 |
| 2014/0197573 | A1 | 7/2014 | Goss | |
| 2014/0250825 | A1* | 9/2014 | Richardson | F16B 7/187 52/710 |
| 2016/0017593 | A1* | 1/2016 | Magee | E04G 15/04 52/699 |
| 2016/0305114 | A1* | 10/2016 | Albartus | E04B 1/4107 |
| 2016/0305115 | A1 | 10/2016 | Albartus et al. | |
| 2017/0121963 | A1* | 5/2017 | Jablonsky | E04B 1/4114 |
| 2020/0141108 | A1* | 5/2020 | Mazzola Vernengo | E04F 11/1812 |

* cited by examiner

ADJUSTABLE CONCRETE ANCHOR TRACK

CROSS REFERENCE TO RELATED APPLICATION(S)

This application claims the benefit of U.S. Provisional Application No. 62/771,269, filed on Nov. 26, 2018, which is incorporated herein by reference in its entirety.

BACKGROUND OF THE INVENTION

Field of the Invention

The present invention is directed generally to anchor assemblies used to attach shear walls to a concrete foundation.

Description of the Related Art

Anchor bolts are used in a concrete foundation to connect structural and nonstructural elements to the concrete. These anchor bolts transfer different types of loads, including tension forces and shear forces. Anchor bolts are generally installed in one of two ways: post-installed and cast-in-place. Installing post-installed anchor bolts involves pouring the concrete first, and then drilling a hole into the concrete. Once the hole is drilled, a post-installed anchor bolt is inserted inside the hole and fixed into place with either an epoxy or a mechanical type bolt.

Cast-in-place anchor bolts are set in position and then concrete is poured around them to fix each of them in its location. After the concrete has been cast, cast-in-place anchor bolts are permanently fixed and cannot be moved. These anchor bolts must be coordinated before-hand with the reinforcement layout and structural elements that will be attached to the foundation.

Unfortunately, cast-in-place anchor bolts that are not placed in the correct location before the concrete cures cannot be used. Post-installation anchors that are placed into the hardened concrete are often used to replace misplaced anchor bolts. However, post-installed anchors typically cannot achieve load requirements of the cast-in-place anchor bolts connected to structural elements.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1A:
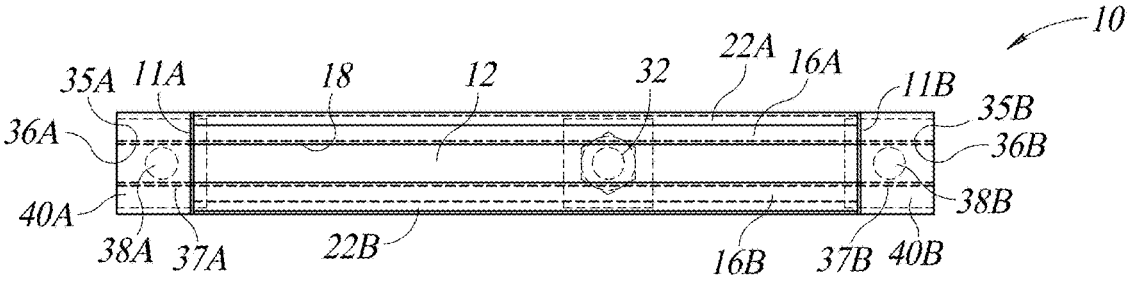
FIG. 1A is a top view of a first embodiment of an adjustable concrete anchor track, a threaded anchor bolt, and concrete anchor rods.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is/are to cover all modifications, alternative constructions, and equivalents falling within the spirit and scope of the inventive concept(s) as defined herein.

Figure 1B:
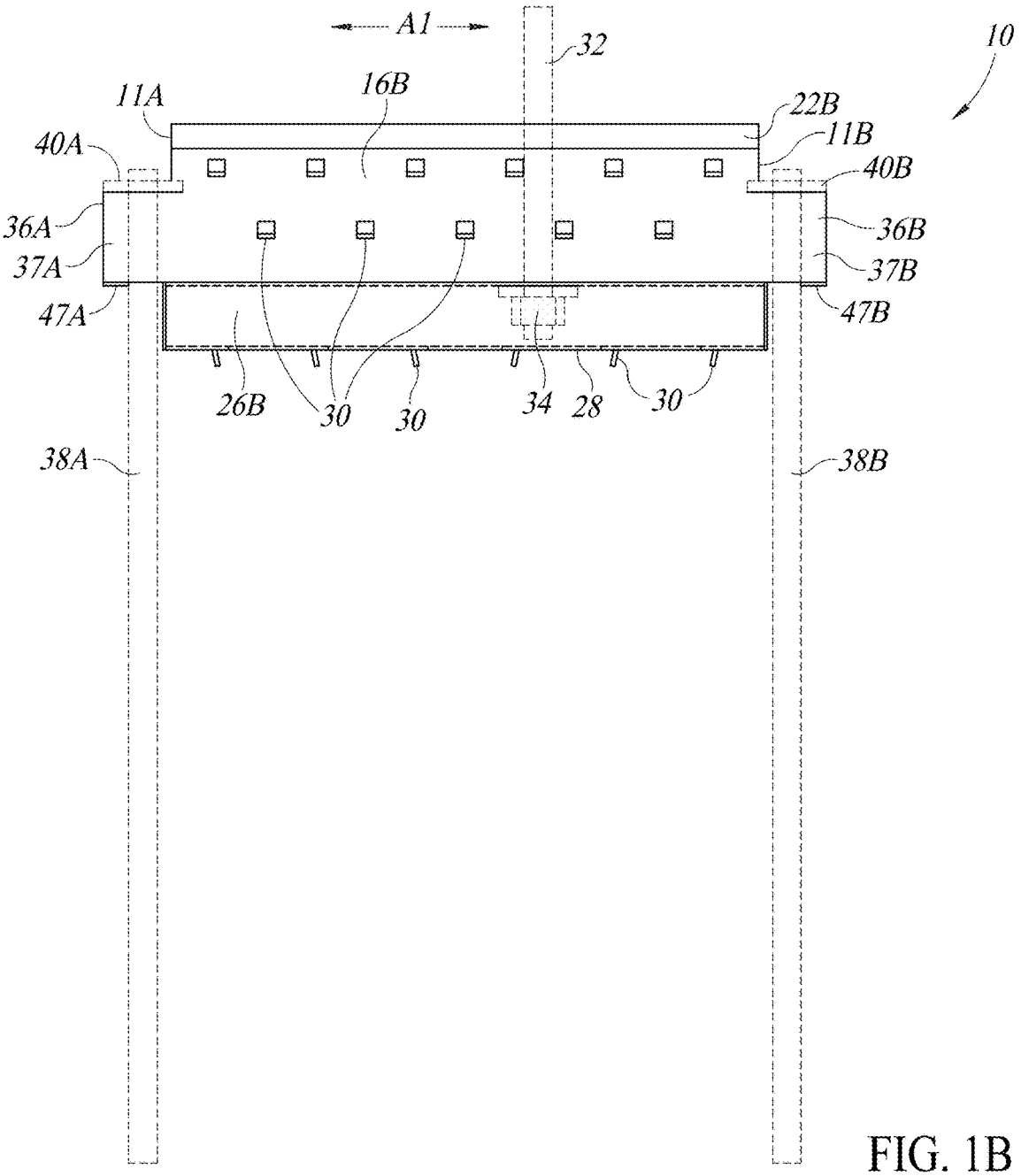
FIG. 1B is a front view of the adjustable concrete anchor track, the threaded anchor bolt, and the concrete anchor rods of FIG. 1A.
Figure 1C:
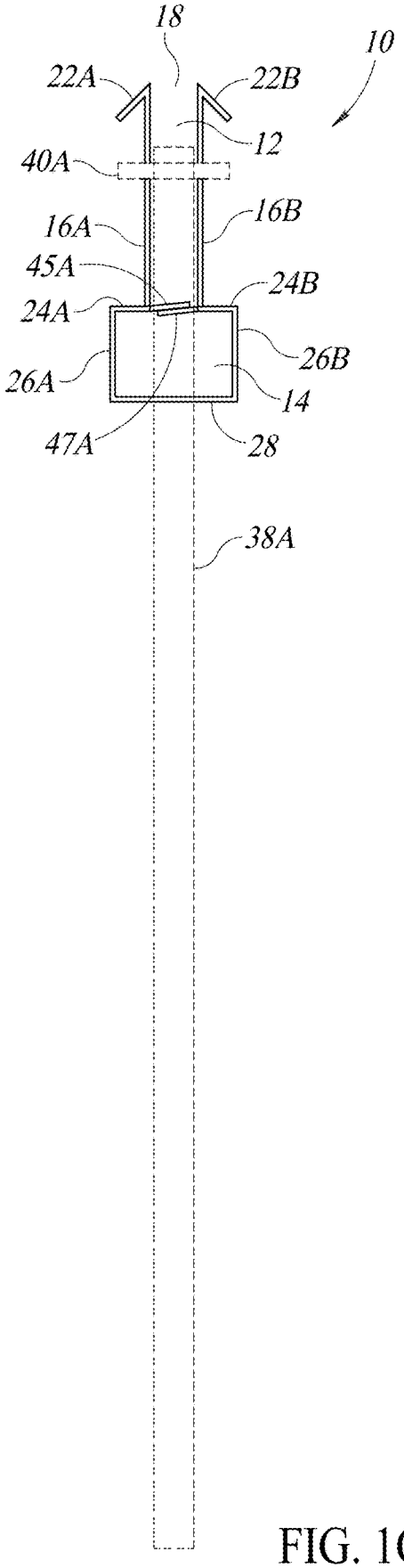
FIG. 1C is a side view of the adjustable concrete anchor track of FIG. 1A omitting the threaded anchor bolt and divots.
Figure 1D:
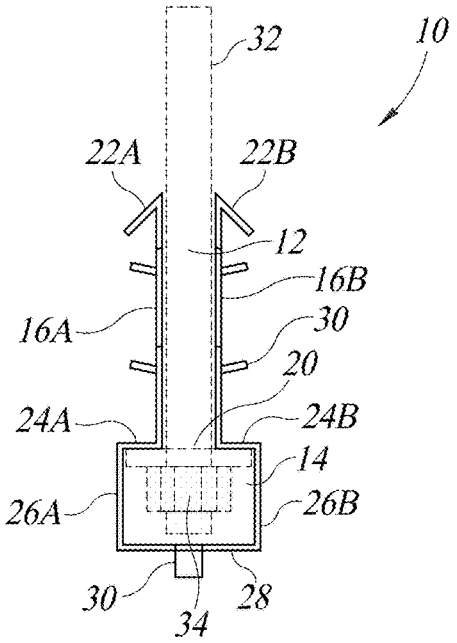
FIG. 1D is a side cross-sectional view of the adjustable concrete anchor track of FIG. 1A taken vertically through its longitudinal midpoint and omitting the concrete anchor rods.

FIGS. 1A-1D illustrate a first embodiment of an anchor track 10 having first and second ends 11A and 11B (see FIGS. 1A and 1B). Referring to FIG. 1D, the anchor track 10 includes an upper channel 12 and a lower channel 14. The lower channel 14 is wider than the upper channel 12. The upper channel 12 is defined between spaced apart walls 16A and 16B that extend the length of the anchor track 10 between the between first and second ends 11A and 11B (see FIGS. 1A and 1B). Referring to FIG. 1C, the upper channel 12 has an upper opening 18 at the top of the walls 16A and 16B. Referring to FIG. 1D, the upper channel 12 has a lower opening 20 that opens to the lower channel 14. The tops of the walls 16A and 16B have eaves 22A and 22B, respectively, that extend outwardly and downwardly from the tops of the walls 16A and 16B, respectively. These eaves 22A and 22B interact with concrete 31 (see FIGS. 3-4B) and provide support for the anchor track 10.

The lower channel 14 is defined between spaced apart walls 26A and 26B that extend the length of the anchor track 10 between the between first and second ends 11A and 11B (see FIGS. 1A and 1B). As mentioned above, the lower opening 20 of the upper channel 12 opens into the lower channel 14. Thus, the lower channel 14 is open along the bottoms of the walls 16A and 16B. However, the lower channel 14 is closed along the bottom of the walls 26A and 26B by a base wall 28. Ledges 24A and 24B extend outwardly from the bottom of the walls 16A and 16B, respectively, of the upper channel 12 and meet the tops of the walls 26A and 26B, respectively, of the lower channel 14. The walls 26A and 26B of the lower channel 14 extend downwardly from the ledges 24A and 24B, respectively, and are attached to the base wall 28. Thus, the upper and lower channels 12 and 14 are continuous and in fluid communication with one another.

Referring to FIG. 1B, extending outwardly from the walls 16A (see FIGS. 1A, 1C, 1D, and 2) and 16B of the upper channel 12 (see FIGS. 1A, 1C, and 1D) and extending downwardly from the base wall 28 are a series of divots 30. These divots 30 protrude out from the walls 16A, 16B, and 28 and are intended to interact with the concrete 31 (see FIGS. 3-4B). The divots 30 can be punch outs from the walls 16A, 16B, and 28, protrusions appended to the walls 16A, 16B, and 28, and the like. The divots 30 hold the anchor track 10 in the concrete 31 (see FIGS. 3-4B). Without being limited by theory, the inventor believes the divots 30 help avoid localized failure in the walls 16A, 16B, and 28 (e.g., each constructed of steel plate) and create composite action between the anchor track 10 and the concrete 31 (see FIGS. 3-4B). The inventor believes this is critical for the walls 16A, 16B, and 28 to transfer high tension loads to the concrete 31 (see FIGS. 3-4B).

Referring to FIG. 1D, passing through the upper channel 12 and the lower channel 14 is an anchor assembly that includes a threaded anchor bolt 32 and a nut/washer assembly 34. The nut/washer assembly 34 is located in the lower channel 14. In alternate embodiments, such as a third embodiment described below, the anchor assembly may be implemented as a T-bolt or similar bolt structure. The nut/washer assembly 34 prevents the threaded anchor bolt 32 from detaching from the anchor track 10 because the nut/washer assembly 34 is secured inside the lower channel 14 by the ledges 24A and 24B, which prevent the nut/washer assembly 34 from passing into the upper channel 12 through the lower opening 20. Referring to FIG. 1B, the threaded anchor bolt 32 is free to move from side-to-side or longitudinally (in directions identified by a double headed arrow "A1" between the first and second ends 11A and 11B) through the upper channel 12 and the lower channel 14. This allows the threaded anchor bolt 32 to be adjusted or moved to a preferred location along the upper and lower channels 12 and 14 (see FIGS. 1C and 1D).

Figure 2:
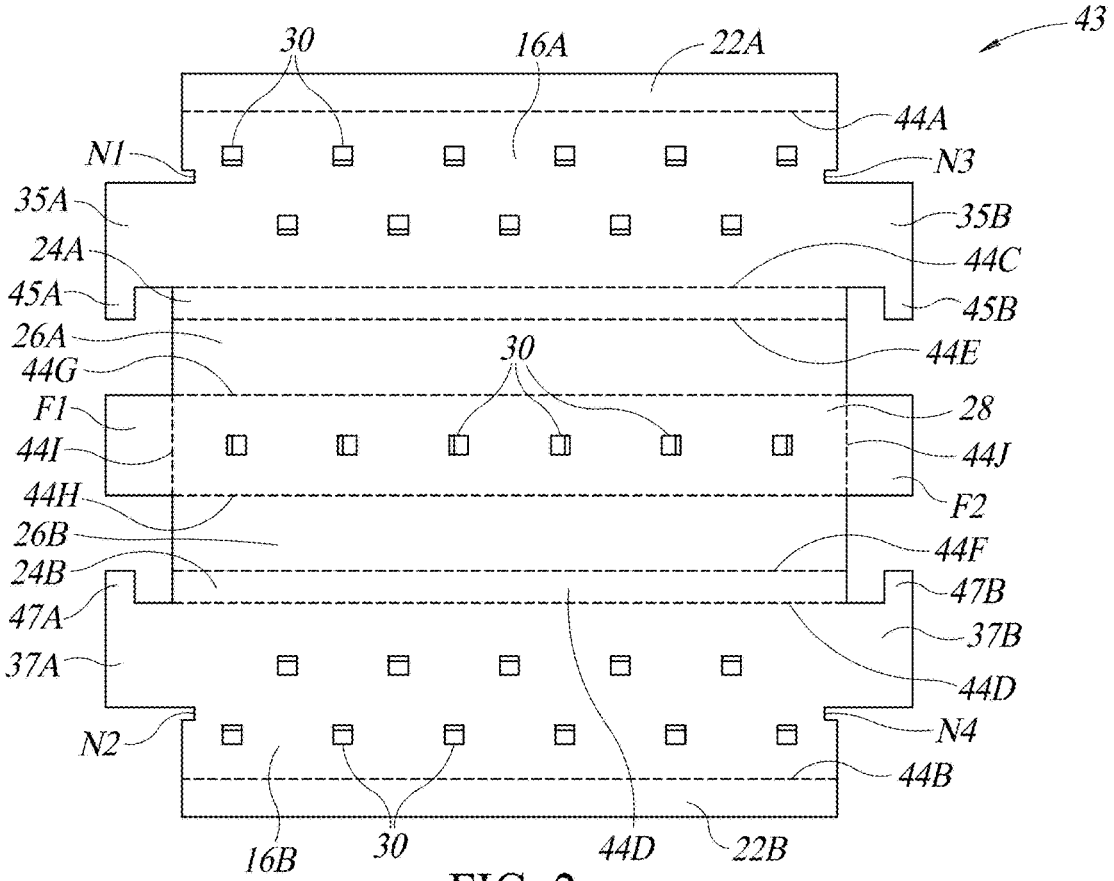
FIG. 2 is a top view of an unfolded sheet used to construct the adjustable concrete anchor track of FIG. 1A.

Referring to FIG. 1A, portions 35A and 35B of the wall 16A extend longitudinally beyond the first and second ends 11A and 11B, respectively. Similarly, portions 37A and 37B of the wall 16B extend longitudinally beyond the first and second ends 11A and 11B, respectively. Referring to FIG. 2, the portions 35A and 35B have downwardly extending tabs 45A and 45B, respectively, configured to be bent upwardly toward one another. The portions 37A and 37B have downwardly extending tabs 47A and 47B, respectively, configured to be bent upwardly toward one another.

Referring to FIG. 1A, together, the portions 35A and 37A define an anchor sleeve 36A. Similarly, together, the portions 35B and 37B define an anchor sleeve 36B. The anchor sleeves 36A and 36B allow concrete anchor rods 38A and 38B, respectively, to be secured to the anchor track 10. Without being limited by theory, the inventor believes the concrete anchor rods 38A and 38B receive tension loads from the anchor track 10 and transfer the tension loads to the concrete 31 (see FIGS. 3-4B). In other words, the inventor believes the concrete anchor rods 38A and 38B extending into the concrete 31 (see FIGS. 3-4B) of a foundation system 29 (see FIGS. 4A and 4B) will ultimately and adequately transfer the tension loads into the foundation system 29. The concrete anchor rods 38A and 38B can be implemented as rebar, anchor bolts, or anchors similar in nature.

The anchor sleeves 36A and 36B are topped by plate washers 40A and 40B, respectively, that secure the concrete anchor rods 38A and 38B, respectively, to the anchor track 10. The anchor track 10 may be notched to receive and secure the plate washers 40A and 40B. The tabs 45A and 47A (see FIG. 2) are fabricated into the anchor sleeve 36A and the tabs 45B and 47B (see FIG. 2) are fabricated into the anchor sleeve 36B. Once the concrete anchor rod 38A is in place, the tabs 45A and 47A can be folded around the concrete anchor rod 38A to lock the concrete anchor rod 38 in place and secure it to the anchor track 10. Similarly, once the concrete anchor rod 38B is in place, the tabs 45B and 47B can be folded around the concrete anchor rod 38B to lock the concrete anchor rod 38B in place and secure it to the anchor track 10.

FIG. 2 illustrates an unfolded sheet 43 that may be used to construct the anchor track 10 (see FIGS. 1A-1D and 3-4B). The sheet 43 may be a pre-fabricated flat metal sheet, with fold lines 44A-44J, which can be bent into the correct shape for installation. The sheet 43 is bent outwardly along the fold lines 44A and 44B to define the eaves 22A and 22B, respectively. The sheet 43 is bent outwardly along the fold lines 44C and 44D to define the walls 16A and 16B, respectively. The sheet 43 is bent inwardly along the fold lines 44E-44H to define the ledges 24A and 24B, the walls 26A and 26B, and the base wall 28. The sheet 43 includes flaps F1 and F2 that fold upwardly along the fold lines 441 and 44J to close the ends of the lower channel 14 at the first and second ends 11A and 11B (see FIGS. 1A and 1B).

As explained above, referring to FIG. 1A, the anchor sleeve 36A is defined by the portions 35A and 37A and the anchor sleeve 36B is defined by the portions 35B and 37B. Referring to FIG. 2, when the sheet 43 is flat as illustrated in FIG. 2, the tabs 45A and 47A extend toward one another and the tabs 45B and 47B extend toward one another. After the sheet 43 is bent along the fold lines 44A-44J, the tabs 45A, 45B, 47A, and 47B each extend downwardly and can be bent upwardly as described above.

As mentioned above, referring to FIG. 1B, the anchor track 10 may be notched to receive and secure the plate washers 40A and 40B. Referring to FIG. 2, the sheet 43 includes notches N1 and N2 configured to receive and secure the plate washer 40A and notches N3 and N4 configured to receive and secure the plate washer 40B. As shown in FIG. 2, the divots 30 may be formed in the sheet 43.

Thus, the entire anchor track 10 (see FIGS. 1A-1D and 3-4B) may be constructed from the single sheet 43. This makes a number of the pre-bent sheets (each like the sheet 43) used to construct the anchor track 10 easily stackable and transportable. Once bent into shape, the anchor track 10 may be positioned in a desired location and the concrete 31 (see FIGS. 3-4B) of the foundation system 29 cast around the anchor track 10 to secure it into position.

Figure 3:
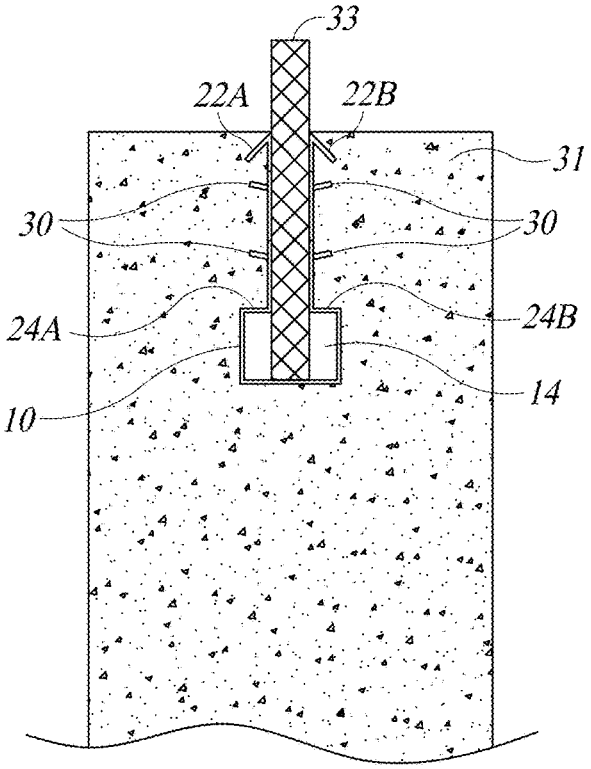
FIG. 3 is a side cross-sectional view of the adjustable concrete anchor track of FIG. 1A installed in concrete taken vertically through the longitudinal midpoint of the adjustable concrete anchor track.

FIG. 3 illustrates the divots 30 and the eaves 22A and 22B interacting with the concrete 31. The divots 30 and the eaves 22A and 22B are arranged at angles that are configured to prevent tension forces from pulling the anchor track 10 from the concrete 31.

The concrete 31 is prevented from entering the upper and lower channels 12 and 14 when the concrete 31 is poured, e.g., by a block insert 33, one or more other structures, or other means. In the example depicted in FIG. 3, the block insert 33 is inserted into the upper opening 18 (see FIGS. 1A and 1C) of the upper channel 12 (see FIGS. 1A, 1C, and 1D) and extends into the lower channel 14 to prevent the concrete 31 from flowing into the upper and lower channels 12 and 14 of the anchor track 10. In other words, the block insert 33 is configured to plug the upper opening 18 (see FIGS. 1A and 1C) and prevent the concrete 31 from entering the upper opening 18. The block insert 33 can be removed once the concrete 31 has cured. However, as mentioned above, the anchor track 10 is not limited to use with the block insert 33 and alternate means may be used to prevent the concrete 31 from entering the upper and lower channels 12 and 14.

Figure 4A:
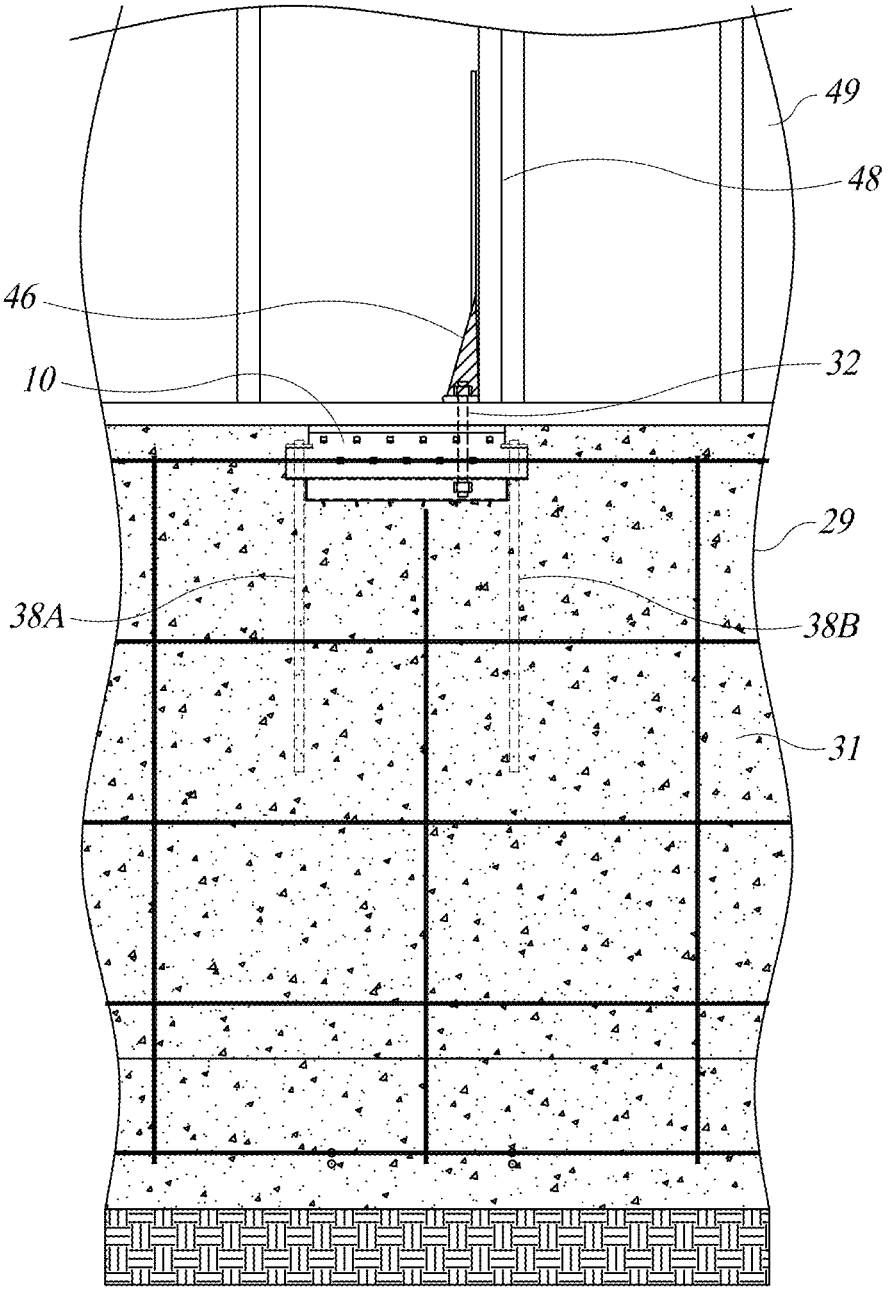
FIG. 4A is a front cross-sectional view of the adjustable concrete anchor track of FIG. 1A installed in the concrete and attached to a holdown anchor.
Figure 4B:
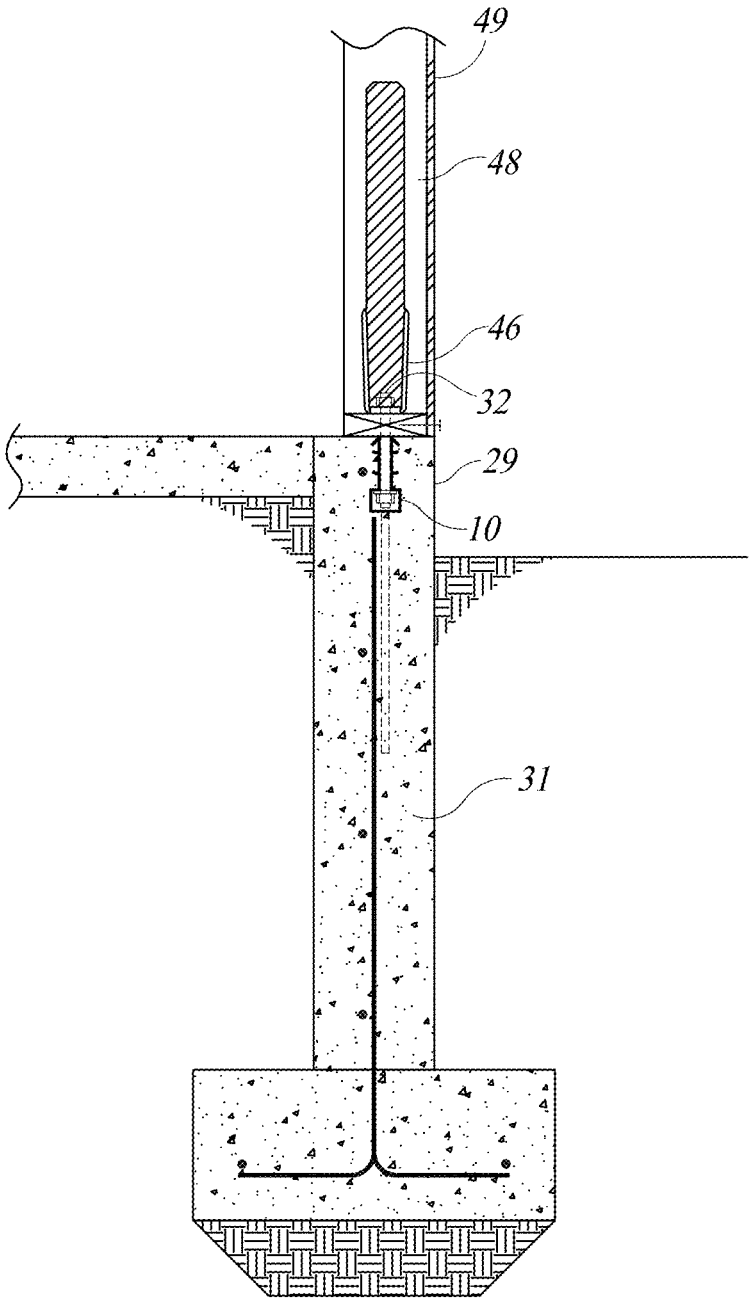
FIG. 4B is a side cross-sectional view of the adjustable concrete anchor track of FIG. 1A installed in the concrete and attached to the holdown anchor.

FIGS. 4A and 4B illustrate the anchor track 10 fully installed in the concrete 31 and attached to a holdown anchor 46. The top of the threaded anchor bolt 32 extends out of the upper opening 18 (see FIGS. 1A and 1C) of the upper channel 12 (see FIGS. 1A, 1C, and 1D), exposing enough of the threaded anchor bolt 32 to be attached and fastened to the holdown anchor 46. This holdown anchor 46 is attached to a shear wall 48 of a structure 49 (e.g., a building). Alternatively, the threaded anchor bolt 32 can be fastened to a holdown anchor attached to heavy equipment, or other structures that require holdown anchors.

Figure 5A:
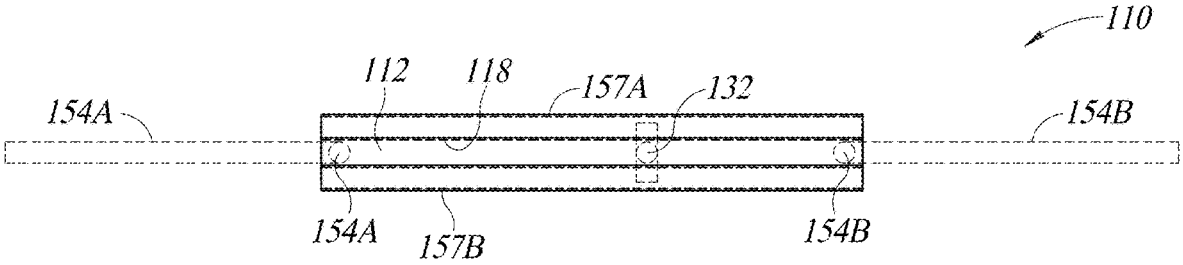
FIG. 5A is a top view of a second embodiment of the adjustable concrete anchor track, a threaded anchor bolt, and hooked rebar anchors.
Figure 5B:
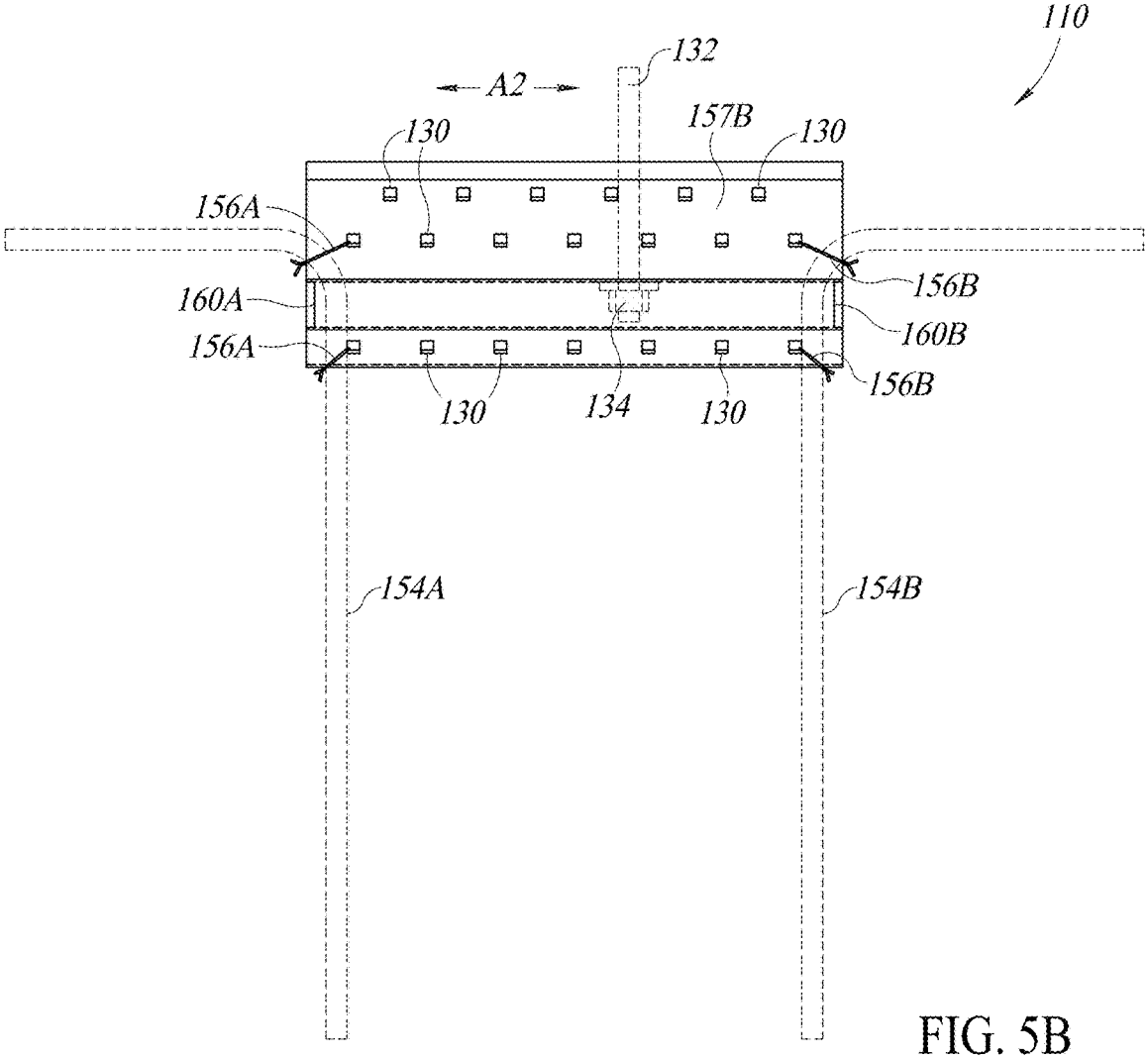
FIG. 5B is a front view of the adjustable concrete anchor track, the threaded anchor bolt, and the hooked rebar anchors of FIG. 5A.
Figure 5C:
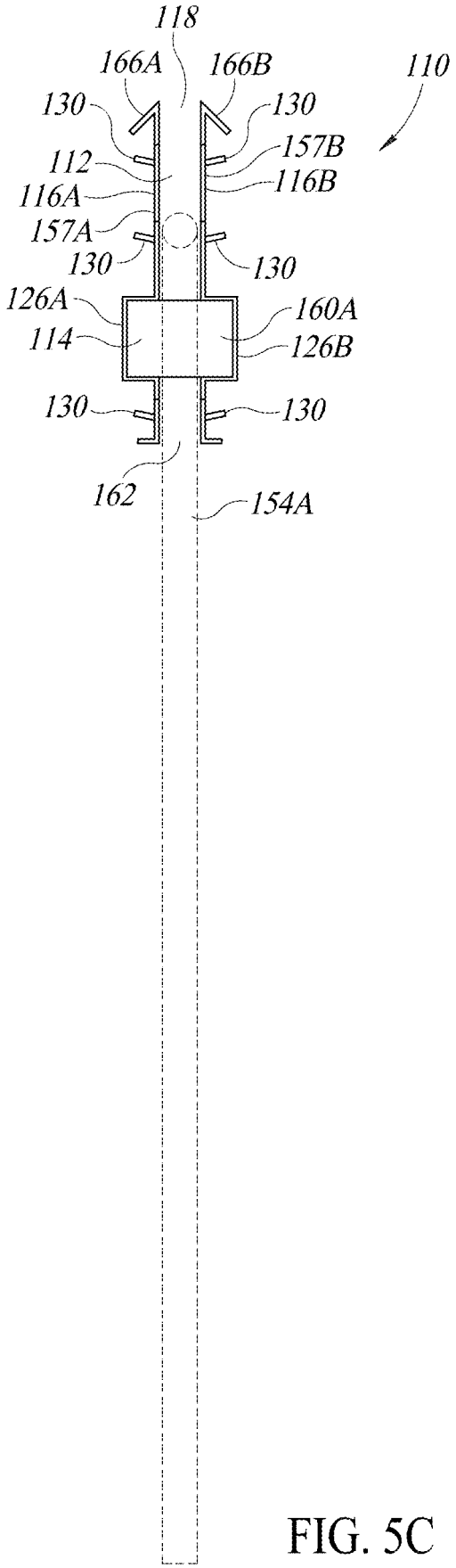
FIG. 5C is a side view of the adjustable concrete anchor track of FIG. 5A omitting the threaded anchor bolt.
Figure 5D:
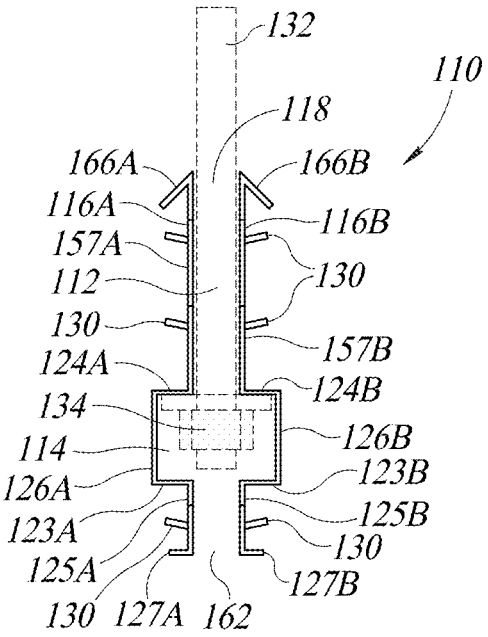
FIG. 5D is a side cross-sectional view of the adjustable concrete anchor track of FIG. 5A taken vertically through its longitudinal midpoint and omitting the hooked rebar anchors.

Illustrated in FIGS. 5A-5D and 7-8B is an alternate second embodiment of an anchor track 110. Referring to FIG. 5C, like the anchor track 10 (see FIGS. 1A-1D and 3-4B), the anchor track 110 has an upper channel 112 in fluid communication with a lower channel 114. The anchor track 110 consists of first and second sides 157A and 157B that are held together by end plates 160A and 160B (see FIG. 5B). The first side 157A has walls 116A and 126A and the second side 157B has walls 116B and 126B. Referring to FIG. 5D, the upper channel 112 is defined between the walls 116A and 116B and the lower channel 114 is defined between the walls 126A and 126B. The upper channel 112 has an upper opening 118 at the top of the walls 116A and 116B. The upper channel 112 is open along its lower portion and opens into the lower channel 114. As shown in FIG. 5D, a bottom portion of the lower channel 114 is open and is not closed by a base wall like the base wall 28 (see FIGS. 1B-1D and 2).

The first and second sides 157A and 157B have eaves 166A and 166B, respectively, and divots 130. The eaves 166A and 166B and the divots 130 are configured to interact with concrete 131 (see FIGS. 7-8B). A ledge 124A extends between the walls 116A and 126A and a ledge 124B extends between the walls 116B and 126B. The ledges 124A and 124B are substantially identical to the ledges 24A and 24B (see FIGS. 1C-3), respectively. Ledges 123A and 123B extend inwardly from the bottoms of the walls 126A and 126B toward one another. However, the ledges 123A and 123B do not close the lower channel 114 along its bottom portion. Spaced apart lower walls 125A and 125B extend downwardly from the ledges 123A and 123B, respectively. Lower flanges 127A and 127B extend outwardly from the bottoms of the lower walls 125A and 125B, respectively. The lower flanges 127A and 127B may be configured to function similar to the eaves 166A and 166B and the divots 130.

Passing through the upper channel 112 and the lower channel 114 is an anchor assembly that includes a threaded anchor bolt 132 and a nut/washer assembly 134. The threaded anchor bolt 132 may be substantially identical to the threaded anchor bolt 32 (see FIGS. 1A, 1B, 1D, 4A, and 4B). The nut/washer assembly 134 is located in the lower channel 114 and may be substantially identical to the nut/washer assembly 34 (see FIGS. 1B and 1D). In alternate embodiments, such as the third embodiment described below, the anchor assembly may be implemented as a T-bolt or similar bolt structure. The nut/washer assembly 134 prevents the threaded anchor bolt 132 from detaching from the anchor track 110 because the nut/washer assembly 134 is secured inside the lower channel 114 by the ledges 124A and 124B, which prevent the nut/washer assembly 134 from entering the upper channel 112.

Figure 7:
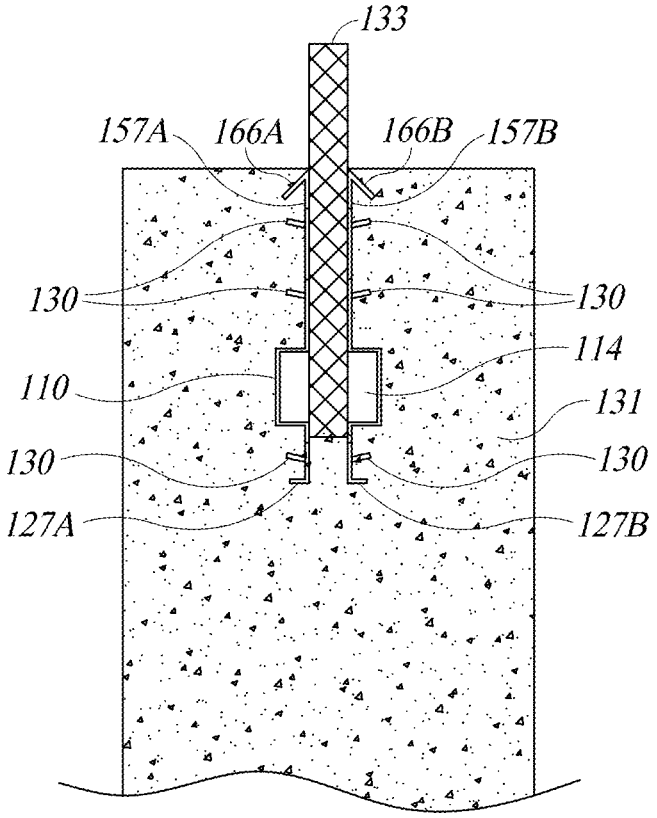
FIG. 7 is a side cross-sectional view of the adjustable concrete anchor track of FIG. 5A installed in concrete taken vertically through the longitudinal midpoint of the adjustable concrete anchor track.

Referring to FIG. 5B, the threaded anchor bolt 132 and the nut/washer assembly 134 are free to move from side-to-side or longitudinally (in directions identified by a double headed arrow "A2" between the first and second end plates 160A and 160B) through the upper channel 112 (see FIGS. 5A, 5C, and 5D) and the lower channel 114 (see FIGS. 5C, 5D, and 7). This allows the threaded anchor bolt 132 to be adjusted or moved to a preferred location along the upper and lower channels 112 and 114.

Referring to FIG. 5B, instead of the anchor sleeves 36A and 36B (see FIGS. 1A and 1B), the anchor track 110 includes the first and second end plates 160A and 160B that close opposite ends of the lower channel 114 (see FIGS. 5C, 5D, and 7). The first and second end plates 160A and 160B do not close the opposite ends of the upper channel 112 (see FIGS. 5A, 5C, and 5D). Thus, the upper channel 112 is open along its first and second ends, which are positioned above the first and second end plates 160A and 160B, respectively.

Figure 8A:
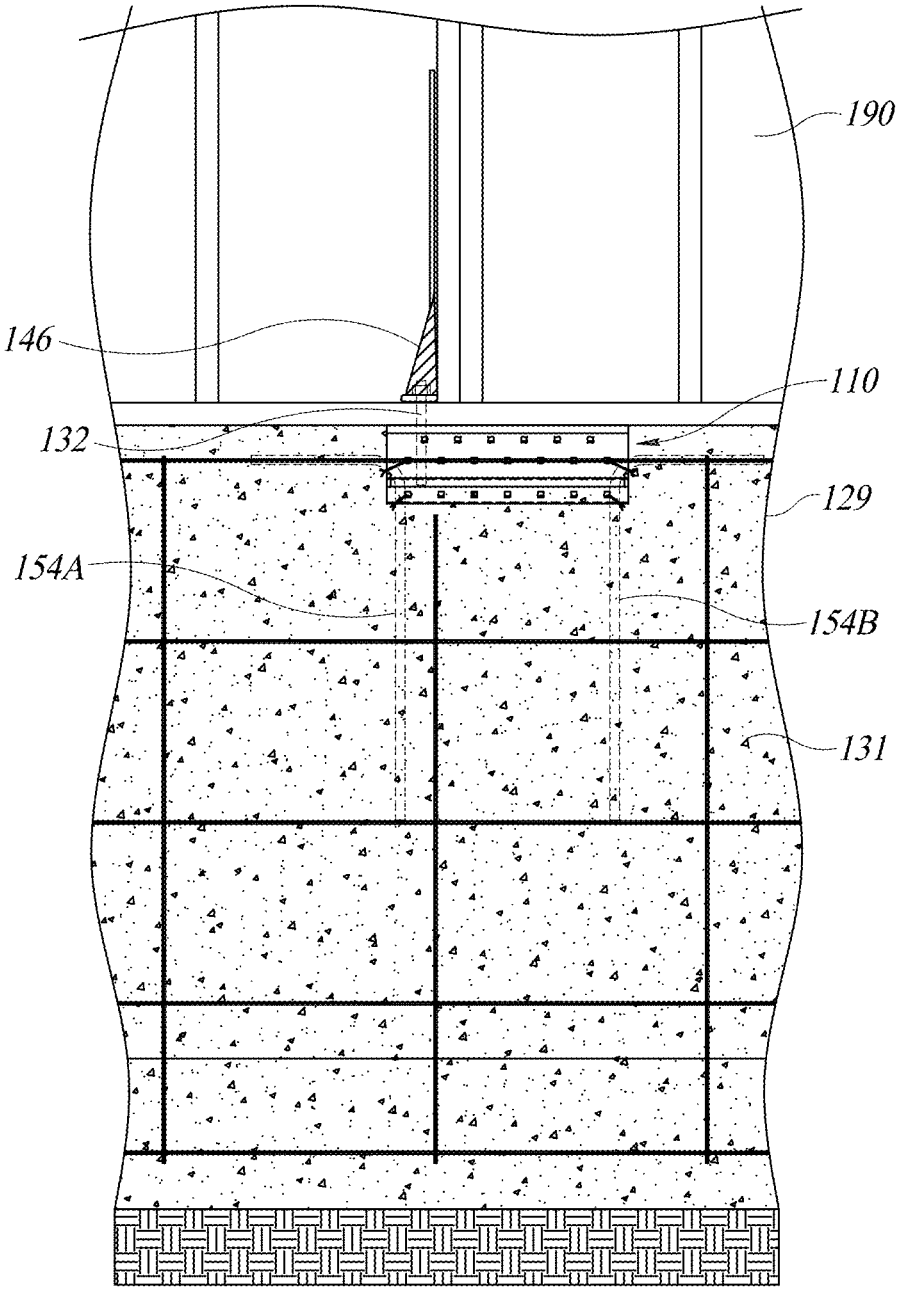
FIG. 8A is a front cross-sectional view of the adjustable concrete anchor track of FIG. 5A installed in concrete and attached to a holdown anchor.

Referring to FIGS. 5C and 5D, a base opening 162 is define between the first and second sides 157A and 157B. The base opening 162 is in fluid communication with the lower channel 114 and is open to concrete 131 (see FIGS. 7-8B). Referring to FIG. 5B, a first hooked rebar anchor 154A can extend horizontally into the upper channel 112 (see FIGS. 5A, 5C, and 5D) through its first open end, bend downwardly into the lower channel 114 (see FIGS. 5C, 5D, and 7), extend through the lower channel 114, and exit the anchor track 110 through the base opening 162 (see FIGS. 5C and 5D). The first hooked rebar anchor 154A may be secured to the anchor track 110 by a pair of first rebar ties or wires 156A. In the embodiment illustrated, each of the first rebar wires 156A extends around the first hooked rebar anchor 154A and through a pair of the divots 130 aligned across the upper and lower channels 112 and 114. A second hooked rebar anchor 154B can extend horizontally into the upper channel 112 (see FIGS. 5A, 5C, and 5D) through its second open end, bend downward into the lower channel 114 (see FIGS. 5C, 5D, and 7), extend through the lower channel 114, and exit the anchor track 110 through the base opening 162 (see FIGS. 5C and 5D). The second hooked rebar anchor 154B may be secured to the anchor track 110 by a pair of second rebar ties or wires 156B. In the embodiment illustrated, each of the second rebar wires 156B extends around the second hooked rebar anchor 154B and through a pair of the divots 130 aligned across the upper and lower channels 112 and 114. Referring to FIG. 8A, the first and second hooked rebar anchors 154A and 154B are configured to extend into the concrete 131 (see FIGS. 7-8B) of a foundation system 129. The inventor believes the anchor track 110 will transfer the tension loads to the first and second hooked rebar anchors 154A and 154B, and they will transfer the tension loads into the foundation system 129.

Figure 6:
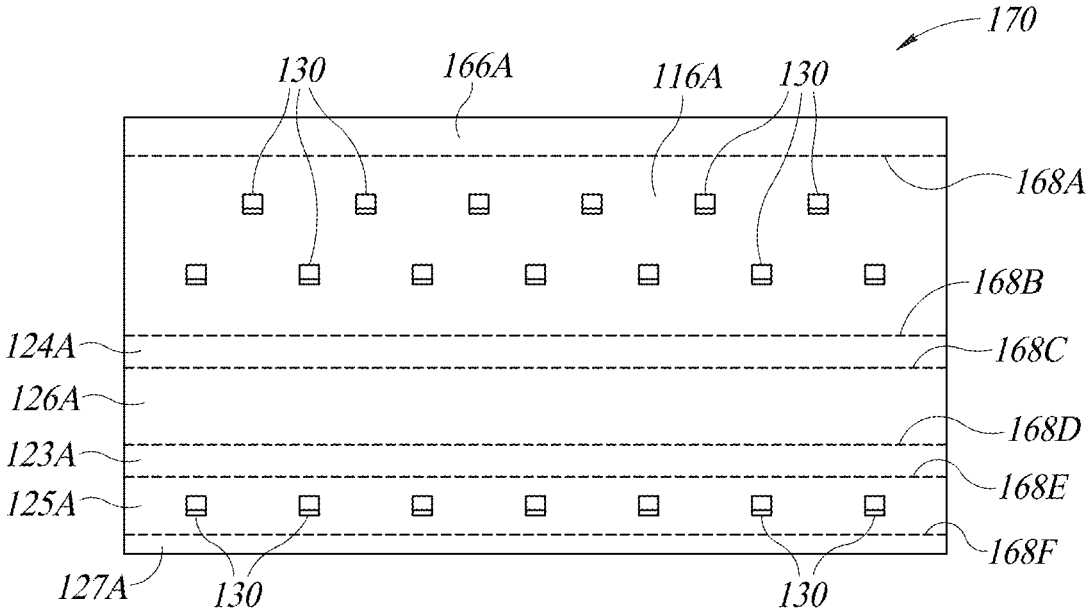
FIG. 6 is a top view of an unfolded sheet used to construct the front or rear side of the adjustable concrete anchor track of FIG. 5A.

Referring to FIG. 5D, the first and second sides 157A and 157B are substantially identical to one another. FIG. 6 illustrates an unfolded sheet 170 that may be used to construct one of the first and second sides 157A and 157B (see FIGS. 5A, 5C, 5D, and 7) of the anchor track 110 (see FIGS. 5A-5D and 7-8B). For the purposes of illustration, FIG. 6 depicts the sheet 170 being used to form the first side 157A. However, the sheet 170 may alternatively be used to form the second side 157B. Further, a pair of sheets each like the sheet 170 may be used to construct the first and second sides 157A and 157B (see FIGS. 5A, 5C, 5D, and 7).

The sheet 170 may be a pre-fabricated flat metal sheet with fold lines 168A-168F, which can be bent into the correct shape for installation. The sheet 170 is bent outwardly along the fold line 168A to define the eave 166A. The sheet 170 is bent outwardly along the fold line 168B to define the wall 116A. The sheet 170 is bent inwardly along the fold lines 116C and 116D to define the ledge 124A and the wall 126A. The sheet 170 is bent outwardly along the fold line 168E to define the ledge 123A. The sheet 170 is bent outwardly along the fold line 168F to define the lower wall 125A and the lower flange 127A. As shown in FIG. 6, the divots 130 may be formed in the sheet 170.

The pair of sheets (each like the sheet 170) used to construct the anchor track 110 (see FIGS. 5A-5D and 7-8B) are easily stackable and transportable. Once bent into shape, referring to FIG. 5B, the anchor track 110 is assembled by positioning the end plates 160A and 160B on opposite sides of the lower channel 114 (see FIGS. 5C, 5D, and 7) and attaching the end plates 160A and 160B to the first and second sides 157A (see FIGS. 5A, 5C, 5D, and 7) and 157B. Then, the hooked rebar anchors 154A and 154B are inserted through the base opening 162 (see FIGS. 5C and 5D) and fed through the first and second open ends, respectively, of the upper channel 112 (see FIGS. 5A, 5C, and 5D). Next, the hooked rebar anchors 154A and 154B are attached to the anchor track 110 by the rebar wires 156A and 156B, respectively. Then, referring to FIGS. 8A and 8B, the concrete 131 (see FIGS. 7-8B) of the foundation system 129 is cast around the anchor track 110, securing it into position.

FIG. 7 illustrates the anchor track 110 being cast in the concrete 131. Referring to FIG. 7, the concrete 131 is prevented from entering the upper and lower channels 112 and 114 when the concrete 131 is poured, e.g., by a block insert 133, one or more other structures, or other means. In the example depicted in FIG. 7, the block insert 133 is inserted into the upper opening 118 (see FIGS. 5A, 5C, and 5D) of the upper channel 112 (see FIGS. 5A, 5C, and 5D) and extends through the upper and lower channels 112 and 114 to prevent the concrete 131 from flowing into the upper and lower channels 112 and 114. In other words, the block insert 133 is configured to plug the upper and lower channels 112 and 114 and prevent the concrete 131 from entering therein. The block insert 133 can be removed after the concrete 131 has cured. However, as mentioned above, the anchor track 110 is not limited to use with the block insert 133 and alternate means may be used to prevent the concrete 131 from entering the upper and lower channels 112 and 114.

Figure 8B:
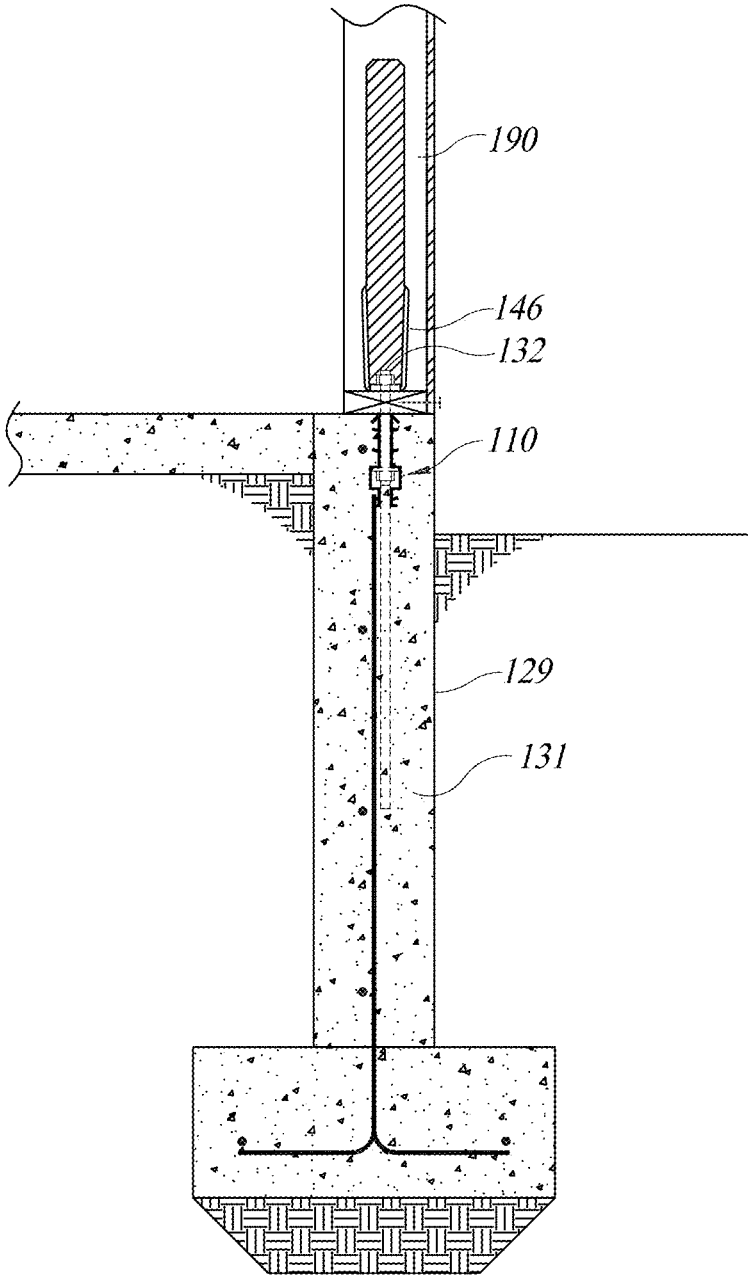
FIG. 8B is a side cross-sectional view of the adjustable concrete anchor track of FIG. 5A installed in the concrete and attached to the holdown anchor.

FIGS. 8A and 8B illustrate the anchor track 110 fully installed and attached to a shear wall 190 by a holdown anchor 146. Thus, in FIGS. 8A and 8B, the anchor track 110 is embedded in the concrete 131 and attached to the holdown anchor 146, which is attached to the shear wall 190. The holdown anchor 146 may be attached to the anchor track 110 is the same manner that the holdown anchor 46 (see FIGS. 4A and 4B) is attached to the anchor track 10 (see FIGS. 1A-1D and 3-4B), which is described above.

Figure 9A:
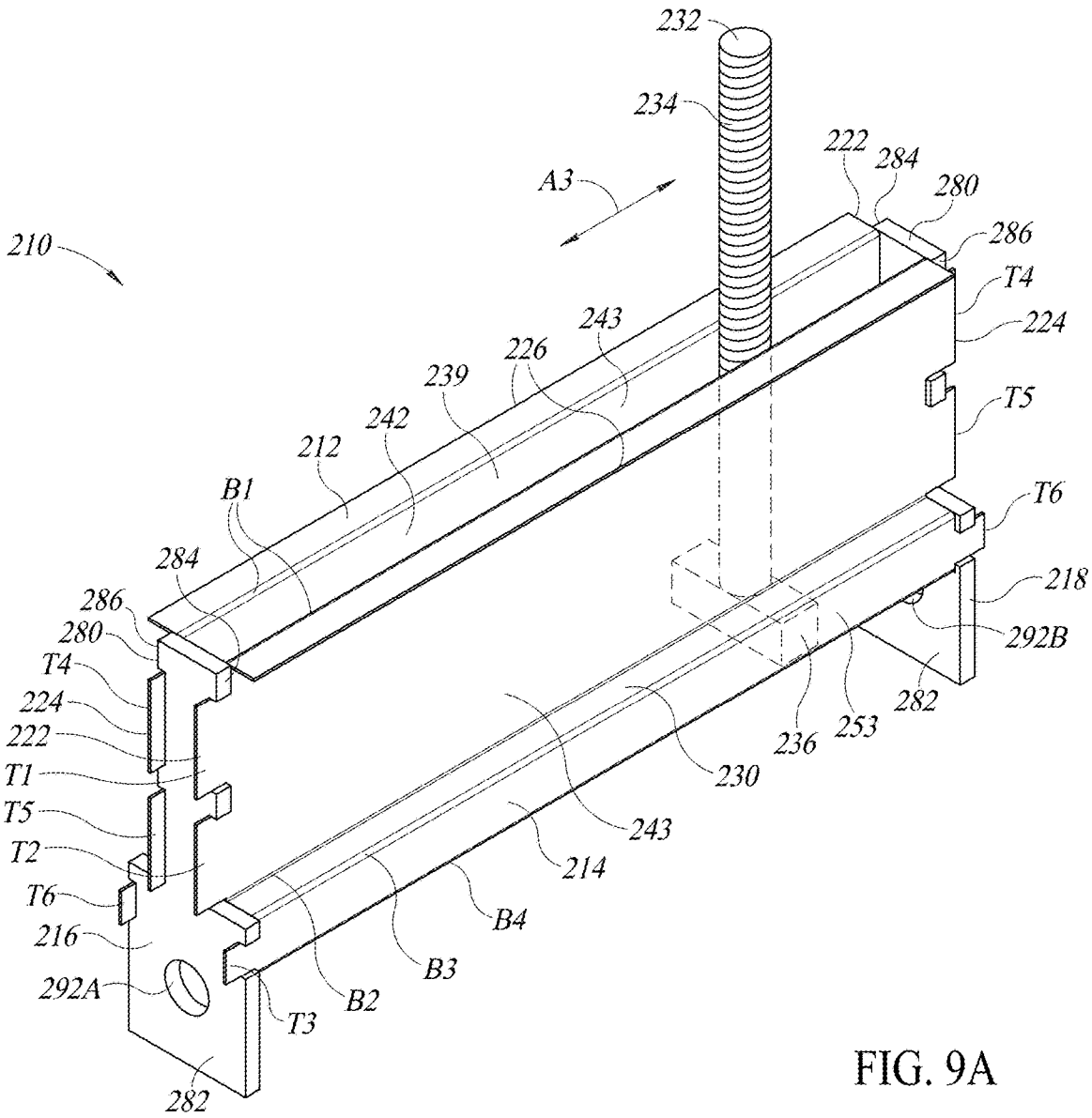
FIG. 9A is a front perspective view of a top portion of a third embodiment of an adjustable concrete anchor track and a threaded anchor.
Figure 9B:
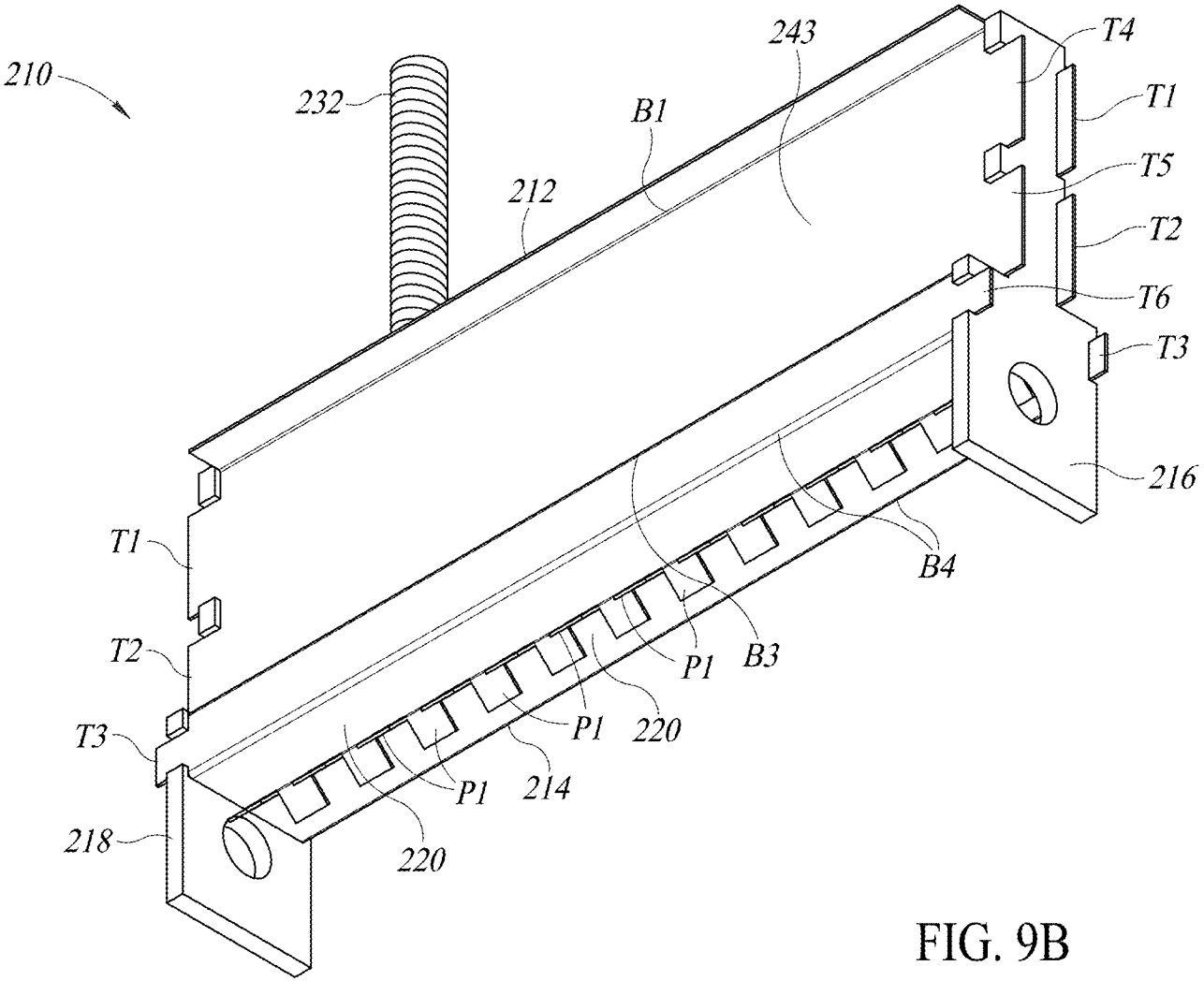
FIG. 9B is a rear perspective view of a bottom portion of the adjustable concrete anchor track and the threaded anchor of FIG. 9A.
Figure 14A:
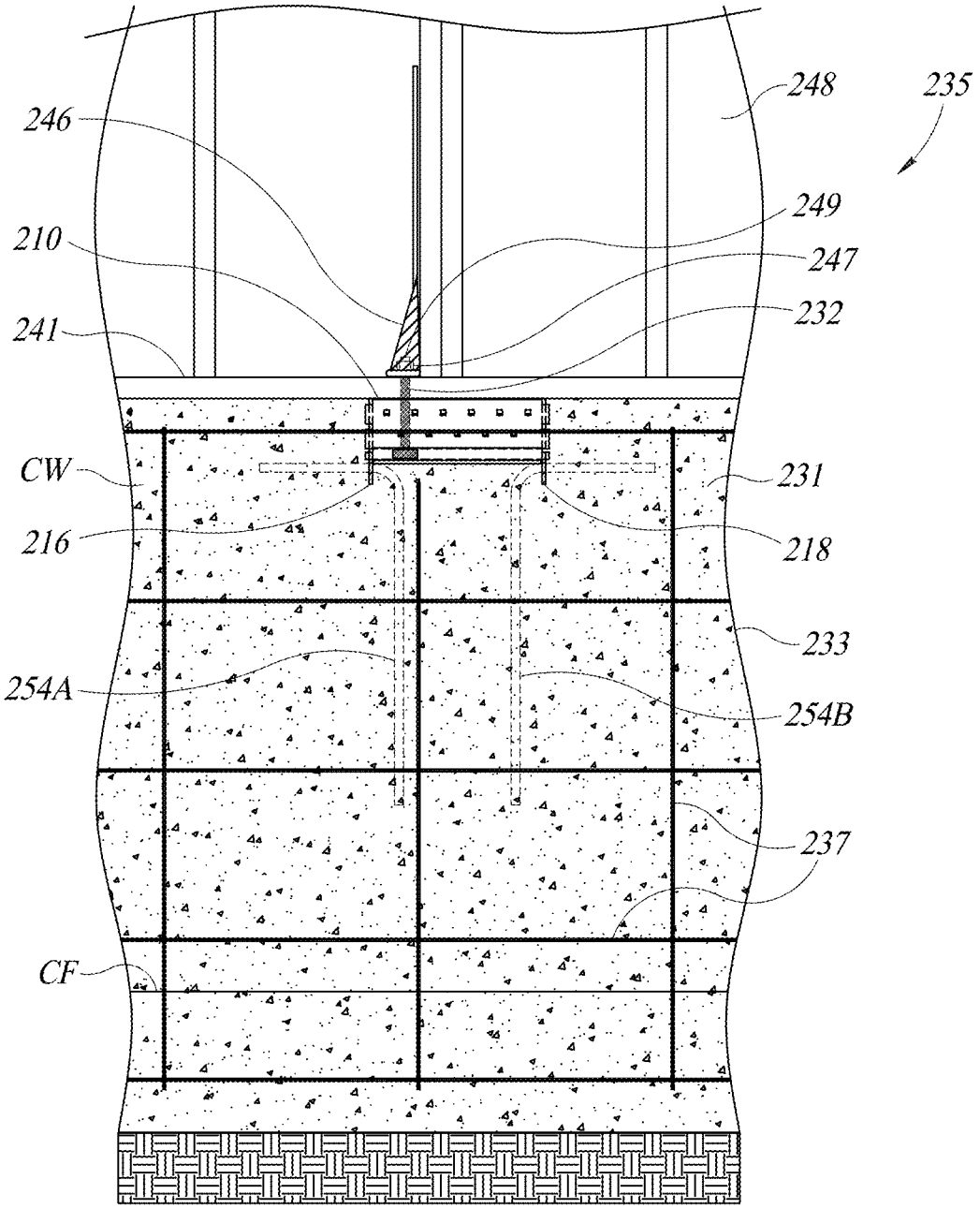
FIG. 14A is a front cross-sectional view of the adjustable concrete anchor track of FIG. 9A installed in concrete and attached to a holdown anchor.
Figure 14B:
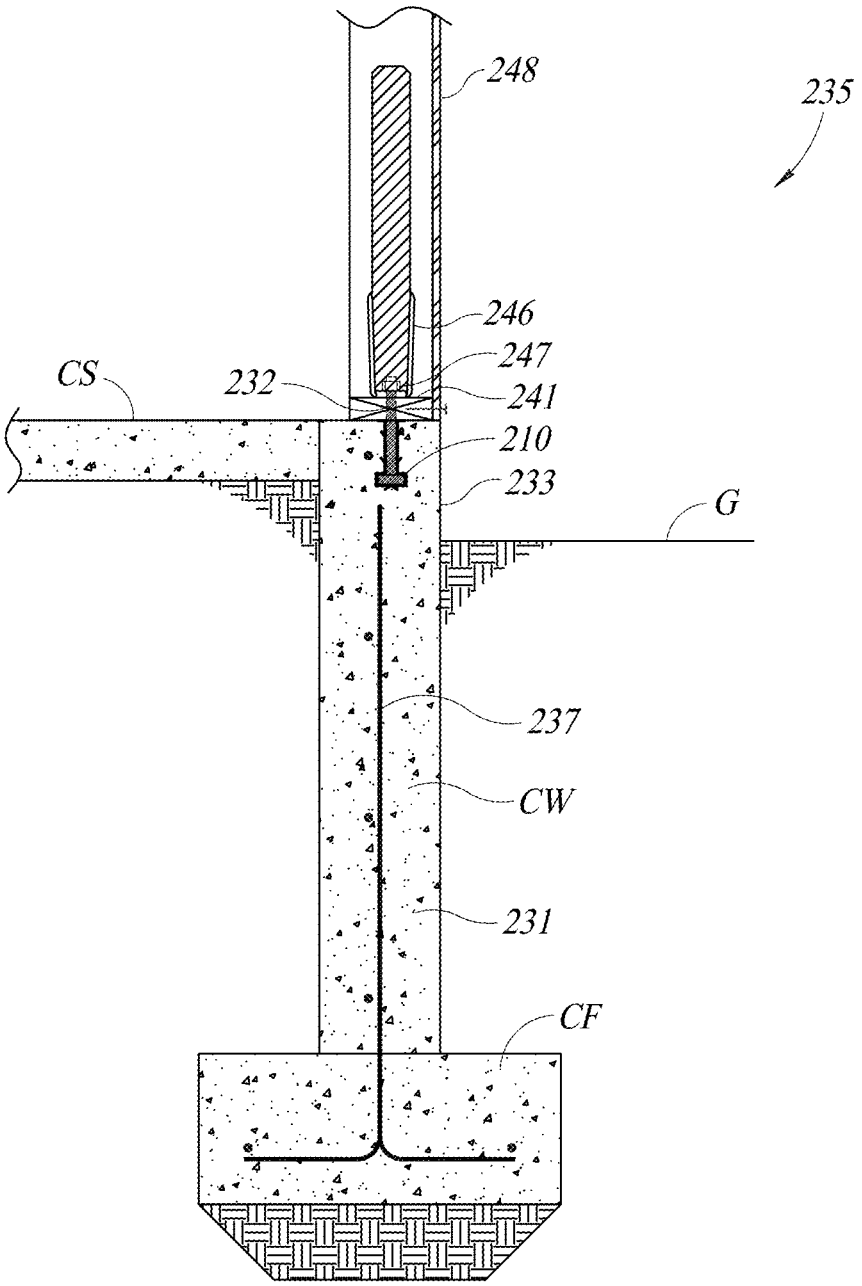
FIG. 14B is a side cross-sectional view of the adjustable concrete anchor track of FIG. 9A installed in the concrete and attached to the holdown anchor.

FIGS. 9A and 9B are perspective views of the alternate third embodiment of an anchor track 210. The anchor track 210 is configured to receive and retain an anchor assembly 232. FIGS. 14A and 14B illustrate the anchor track 210 embedded in concrete 231 that forms part of a foundation system 233 of a structure 235 (e.g., a building). The anchor assembly 232 is coupled to a holdown anchor 246 that is coupled to a shear wall 248 (e.g., to a wall stud) of the structure 235. In the embodiment illustrated, the holdown anchor 246 is positioned on a conventional bottom plate or track 241. The foundation system 233 illustrated includes a concrete slab CS (see FIG. 14B), a reinforced concrete wall CW, and a concrete footing CF. The reinforced concrete wall CW has rebar 237 embedded therein. FIG. 14B also illustrates a finished grade G. The holdown anchor 246 is substantially identical to the holdown anchor 46 (see FIGS. 4A and 4B) and the holdown anchor 146 (see FIGS. 8A and 8B).

In the embodiment illustrated in FIG. 14A, the holdown anchor 246 has a through-hole (not shown) configured to receive an upper free end portion 249 of the anchor assembly 232. After the upper free end portion 249 of the anchor assembly 232 is inserted into the through-hole (not shown), a fastener 247 (e.g., a nut) is attached to the upper free end portion 249 to thereby connect the anchor assembly 232 and the holdown anchor 246 together. The anchor assembly 232 may include a threaded anchor bolt substantially identical to the threaded anchor bolt 32 (see FIGS. 1A, 1B, 1D, 4A, and 4B) and a nut/washer assembly substantially identical to the nut/washer assembly 34 (see FIGS. 1B and 1D). In such embodiments, the threaded anchor bolt may be coupled to the anchor track 210 by the nut/washer assembly. Alternatively, referring to FIG. 10, the anchor assembly 232 may be a T-bolt type anchor having a threaded rod portion 234 coupled to a transverse member 236. Additionally, the anchor assembly 232 may be implemented using alternate anchor styles. While described as being an anchor assembly, the anchor assembly 232 may include only a single unitary component or multiple components.

Referring to FIG. 9A, the anchor track 210 includes a first side member 212, a second side member 214, a first end plate 216, and a second end plate 218. The first side member 212 may be substantially identical to the second side member 214. Each of the first and second side members 212 and 214 has a first end portion 222 opposite a second end portion 224. The first end portion 222 has outwardly extending tabs T1-T3 and the second end portion 224 has outwardly extending tabs T4-T6.

Each of the first and second side members 212 and 214 has a longitudinally extending first bend B1 that defines an outwardly bent upper flange 226. The first bend B1 is positioned above the tabs T1 and T4. Spaced downwardly from the first bend B1, each of the first and second side members 212 and 214 has a longitudinally extending second bend B2. The second bend B2 is positioned below the tabs T2 and T5 and above the tabs T3 and T6. Spaced downwardly from the second bend B2, each of the first and second side members 212 and 214 has a longitudinally extending third bend B3. An outwardly extending ledge portion 230 extends between the second and third bends B2 and B3. The third bend B3 bends each of the first and second side members 212 and 214 downwardly. The third bend B3 is positioned above the tabs T3 and T6. Below the tabs T3 and T6, each of the first and second side members 212 and 214 has a longitudinally extending fourth bend B4. Referring to FIG. 9B, the fourth bend B4 bends each of the first and second side members 212 and 214 inwardly to define a base wall portion 220 in each of the first and second side members 212 and 214.

Figure 11A:
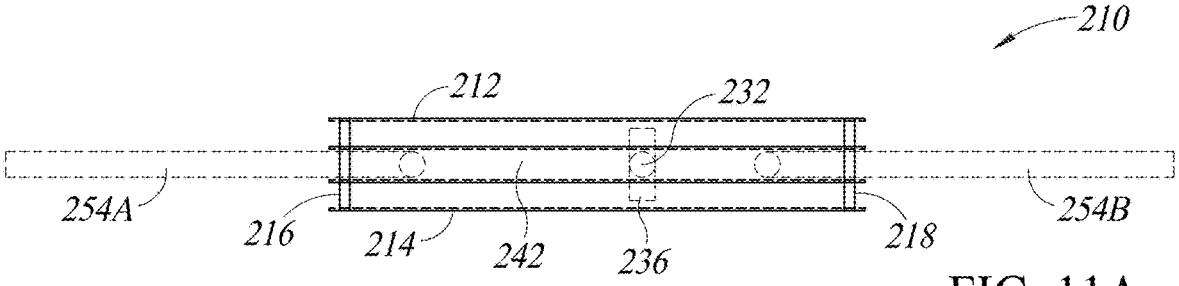
FIG. 11A is a top view of the threaded anchor and the adjustable concrete anchor track of FIG. 9A illustrated with concrete anchors.
Figure 11B:
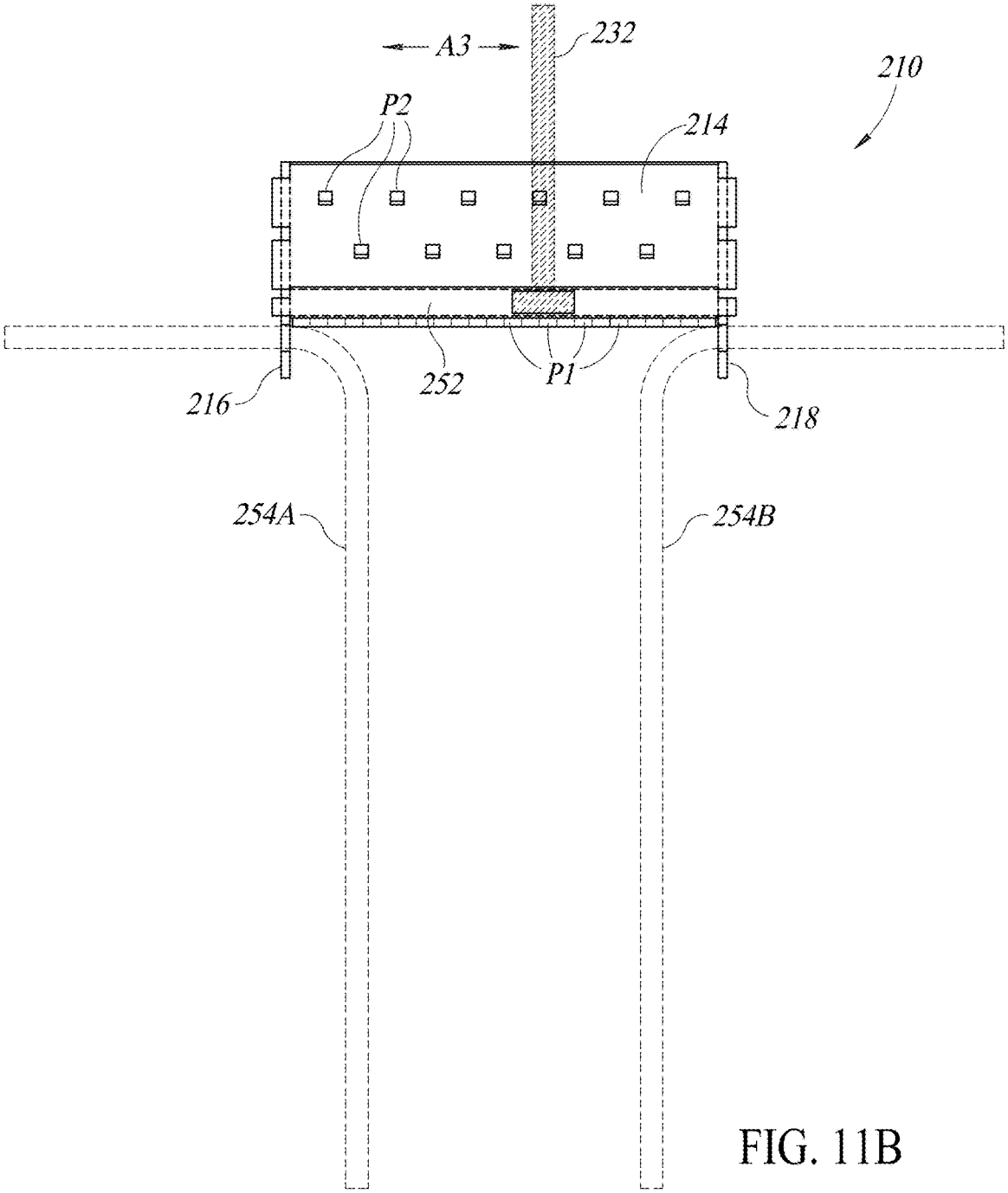
FIG. 11B is a front view of the threaded anchor and the adjustable concrete anchor track of FIG. 9A illustrated with the concrete anchors.
Figure 11C:
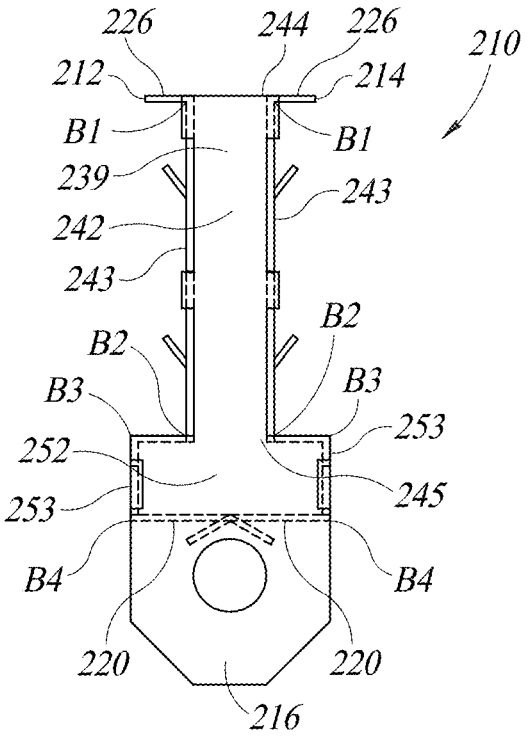
FIG. 11C is a side view of the adjustable concrete anchor track of FIG. 9A omitting the threaded anchor.

Referring to FIG. 9A, a longitudinally extending channel 239 is defined between the first and second side members 212 and 214. Referring to FIG. 11C, the channel 239 includes an upper channel portion 242 and a lower channel portion 252. The upper channel portion 242 is defined between an upper sidewall portion 243 of each of the first and second side members 212 and 214. Referring to FIG. 9A, the upper sidewall portion 243 is defined between the first and second bends B1 and B2 and includes the tabs T1, T2, T4, and T5. Referring to FIG. 11C, the upper channel portion 242 has an upper opening 244 opposite a lower opening 245.

The lower channel portion 252 is defined between a lower sidewall portion 253 of each of the first and second side members 212 and 214. Referring to FIG. 9A, the lower sidewall portion 253 is defined between the third and fourth bends B3 and B4 and includes the tabs T3 and T6. Referring to FIG. 11C, the lower opening 245 of the upper channel portion 242 opens in the lower channel portion 252. Thus, the lower channel portion 252 is open along its upper edge and is continuous with the upper channel portion 242. The base wall portions 220 are configured extend toward one another when the anchor track 210 is assembled. Thus, the lower channel portion 252 is at least partially closed along its lower edge by the base wall portions 220. Referring to FIG. 9A, the anchor assembly 232 is slidable longitudinally inside the upper and lower channel portions 242 and 252 (see FIG. 11C) along directions identified by a double headed arrow "A3" between the first and second end plates 216 and 218.

Figure 11D:
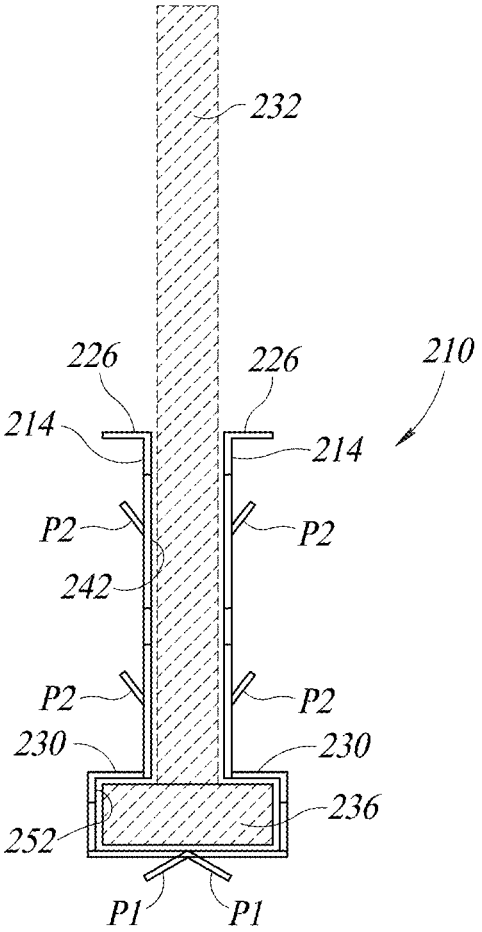
FIG. 11D is a side cross-sectional view of the adjustable concrete anchor track of FIG. 9A taken vertically through the threaded anchor.

Referring to FIG. 11D, the lower channel portion 252 is wider than the upper channel portion 242 and is configured to house the transverse member 236 (or the nut/washer assembly) of the anchor assembly 232. The ledge portions 230 are configured to prevent the transverse member 236 (or the nut/washer assembly) from exiting the lower channel portion 252 and entering the upper channel portion 242 through the lower opening 245 (see FIG. 11C). Thus, the ledge portions 230 trap the transverse member 236 (or the nut/washer assembly) inside the lower channel portion 252.

Figure 12:
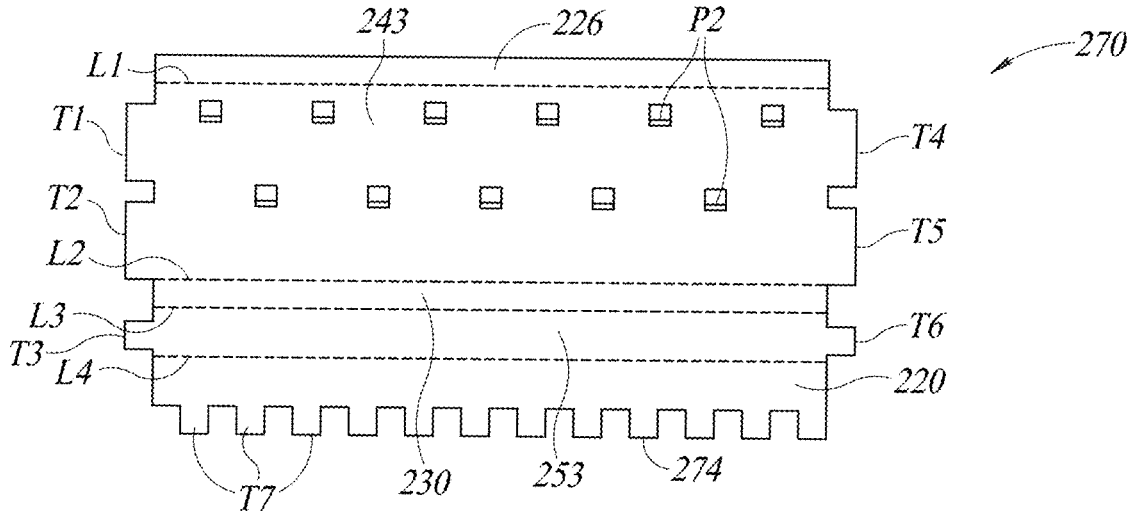
FIG. 12 is a top view of an unfolded sheet used to construct the front or rear side of the adjustable concrete anchor track of FIG. 9A.

As mentioned above, the first side member 212 may be substantially identical to the second side member 214. FIG. 12 illustrates an unfolded or flat sheet 270 that may be used to construct each of the first and second side members 212 and 214 (see FIGS. 9A-11A, 11C, 11D, and 13). The sheet 270 may be a pre-fabricated flat metal sheet, with fold lines L1-L4, which, when bent, form the bends B1-B4 (see FIGS. 9A and 11C), respectively. By forming the bends B1-B4, the sheet 270 is bent into the correct shape for installation. A pair of pre-bent sheets (not shown) each substantially identical to the sheet 270 are easily stackable and transportable and may be used to construct the first and second side members 212 and 214. Once assembled, the anchor track 210 may be positioned in a desired location and the concrete 231 (see FIGS. 13-14B) of the foundation system 233 (see FIGS. 14A and 14B) may be cast around the anchor track 210 to secure it into position.

Figure 13:
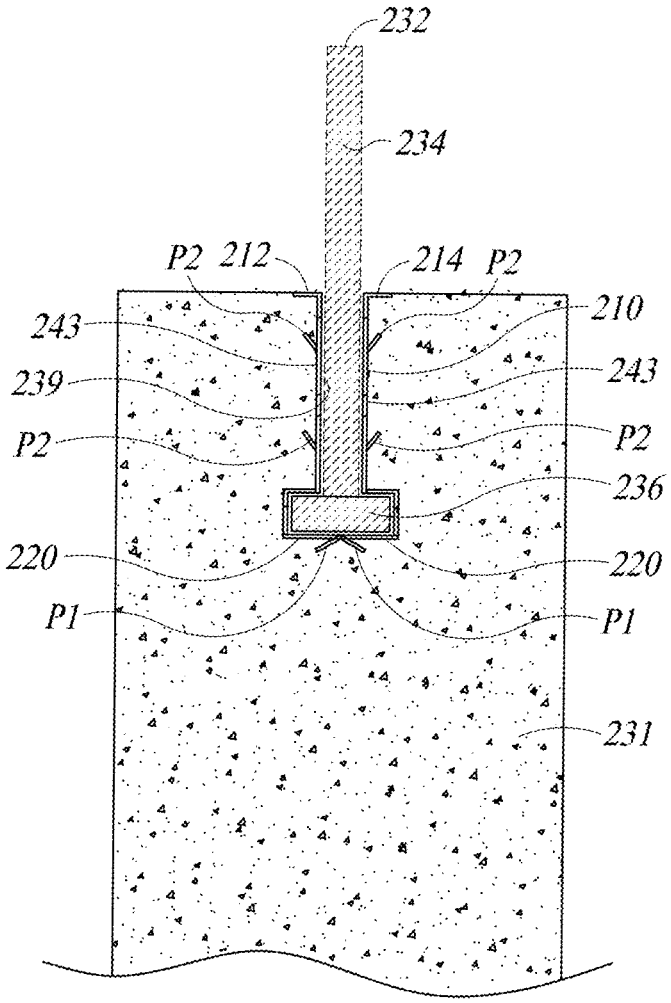
FIG. 13 is a side cross-sectional view of the adjustable concrete anchor track of FIG. 9A installed in concrete taken vertically through a longitudinal midpoint of the adjustable concrete anchor track.

In the embodiment illustrated, the base wall portion 220 of the sheet 270 has an edge 274 with outwardly extending tabs T7 formed therein. The tabs T7 may be bent downwardly at an angle with respect to horizontal when the anchor track 210 is positioned upright as illustrated in FIGS. 11B, 11D, and 13. Referring to FIG. 13, when bent in this manner, the tabs T7 (see FIG. 12) form projections P1. Portions of the upper sidewall portion 243 of the sheet 270 may be cut to define additional projections P2 that are bent outwardly. For example, the projections P2 may be constructed by punching them into the upper sidewall portion 243. While the anchor track 210 has been illustrated and described as including the projections P1 and P2, in alternate embodiments, the anchor track 210 may include grooves, divots, contours, and the like, instead of or in addition to the projections P1 and P2. The projections P1 and P2 and/or similar structures (e.g., grooves, divots, contours, and the like) formed in the first and second side members 212 and 214 are configured to translate, directly to the concrete 231, downwardly directed compressive forces and/or upwardly directed tension forces applied to the first and second side members 212 and 214 (by the anchor assembly 232 and the holdown anchor 246 illustrated in FIGS. 14A and 14B). The projections P1 and P2 and/or similar structures help prevent localized failures in the first and second side members 212 and 214.

Figure 10:
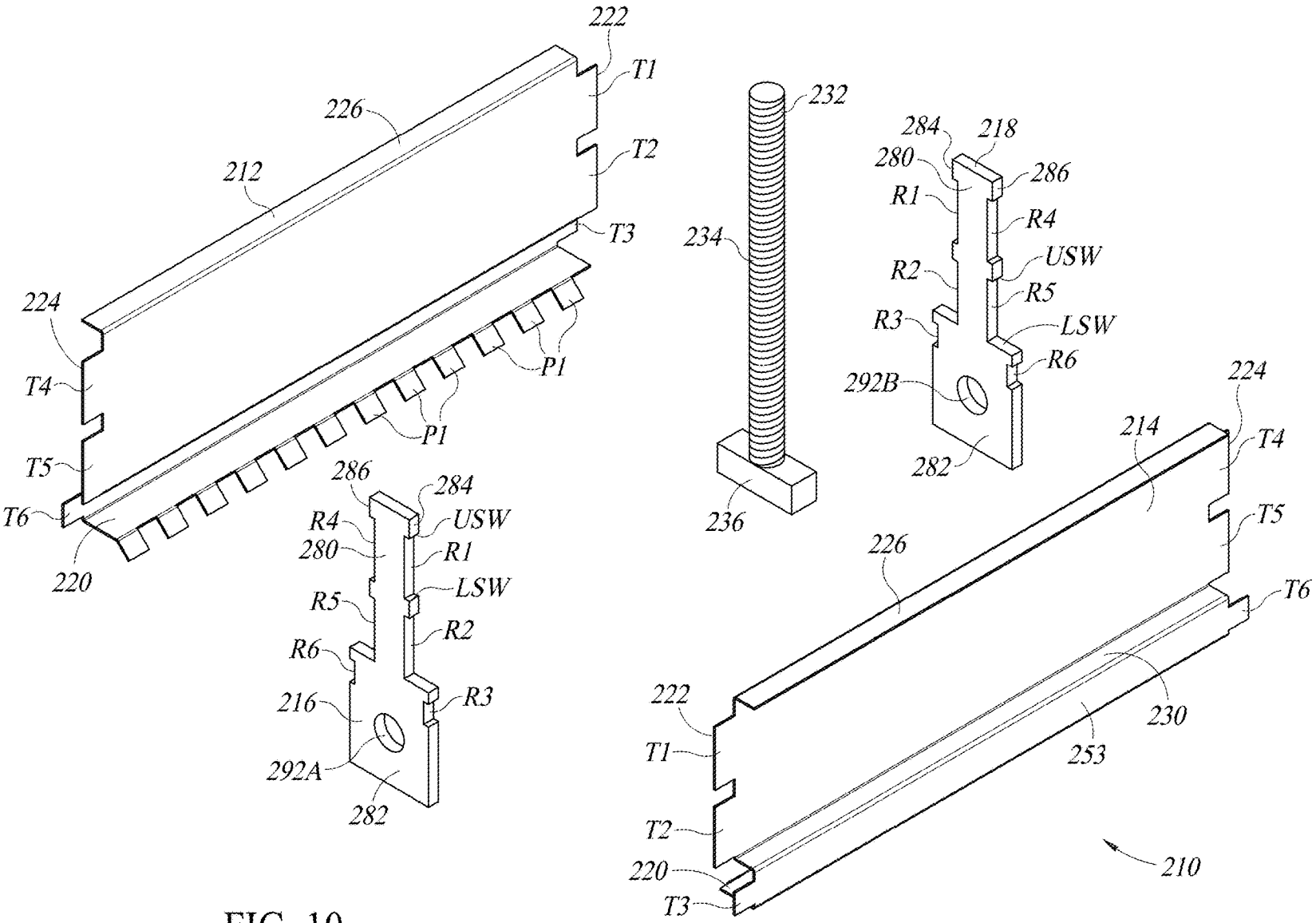
FIG. 10 is an exploded perspective view of the top portion of the adjustable concrete anchor track and the threaded anchor of FIG. 9A.

Referring to FIG. 10, the first end plate 216 may be substantially identical to the second end plate 218. Each of the first and second end plates 216 and 218 is generally shaped like an inverted T with a leg portion 280 that extends upwardly from a transverse base portion 282.

Along its first side 284, the leg portion 280 of the first end plate 216 has recesses R1 and R2. Similar, along its first side 284, the leg portion 280 of the second end plate 218 has the recesses R1 and R2. The recesses R1 and R2 of the first end plate 216 are configured to receive the tabs T1 and T2 of the second side member 214 and the recesses R1 and R2 of the second end plate 218 are configured to receive the tabs T1 and T2 of the first side member 212. Along its second side 286, the leg portion 280 of the first end plate 216 has recesses R4 and R5. Similarly, along its second side 286, the leg portion 280 of the second end plate 218 has the recesses R4 and R5. The recesses R4 and R5 of the first end plate 216 are configured to receive the tabs T4 and T5 of the first side member 212 and the recesses R4 and R5 of the second end plate 218 are configured to receive the tabs T4 and T5 of the second side member 214. In other words, the recesses R1 and R2 of the first end plate 216 receive the tabs T1 and T2 of the second side member 214 and the recesses R4 and R5 of the first end plate 216 receive the tabs T4 and T5 of the first side member 212. Also, the recesses R1 and R2 of the second end plate 218 receive the tabs T1 and T2 of the first side member 212 and the recesses R4 and R5 of the second end plate 218 receive the tabs T4 and T5 of the second side member 214.

The transverse base portions 282 of the first and second end plates 216 and 218 each have recesses R3 and R6. The recess R3 of the first end plate 216 is configured to receive the tab T3 of the second side member 214 and the recess R6 of the first end plate 216 is configured to receive the tab T6 of the first side member 212. The recess R3 of the second end plate 218 is configured to receive the tab T3 of the first side member 212 and the recess R6 of the second end plate 218 is configured to receive the tab T6 of the second side member 214.

The transverse base portions 282 of the first and second end plates 216 and 218 include through-holes 292A and 292B, respectively. The through-holes 292A and 292B are configured to receive first and second concrete anchors 254A and 254B (see FIGS. 11A, 11B, and 14A), respectively, and allow them to pass therethrough. Referring to FIG. 14A, the first and second concrete anchors 254A and 254B may be implemented as bent rebar anchors, hooked rebar anchors, threaded bolt type anchors, and the like.

The holdown anchor 246 receives tension and/or compression forces (referred to as "holdown forces") from whatever the holdown anchor 246 is coupled to (e.g., the shear wall 248). The holdown anchor 246 transfers the holdown forces to the anchor assembly 232, which transfers the holdown forces to the first and second side members 212 and 214 (see FIGS. 9A-11A, 11C, 11D, and 13). Specifically, the anchor assembly 232 transfers the holdown forces to the inside of the lower channel portion 252 (see FIGS. 11B-11D).

Referring to FIG. 10, each of the recesses R1-R6 has an upper stop wall USW and a lower stop wall LSW configured to receive tension and compression forces, respectively. The upper stop walls USW of the recesses R1-R6 translate upwardly directed tension forces applied to the first and second side members 212 and 214 (e.g., by the anchor assembly 232) to the first and second end plates 216 and 218. The first and second end plates 216 and 218 translate the upwardly directed tension forces to the first and second concrete anchors 254A and 254B (see FIGS. 11A, 11B, and 14A), respectively. Referring to FIG. 14A, the first and second concrete anchors 254A and 254B translate that force to the concrete 231. Returning to FIG. 10, the lower stop walls LSW of the recesses R1-R6 translate downwardly directed compression forces applied to the first and second side members 212 and 214 (e.g., by the anchor assembly 232) to the first and second end plates 216 and 218. Referring to FIG. 14A, the first and second end plates 216 and 218 translate the downwardly directed compressive forces to the first and second concrete anchors 254A and 254B, respectively, which translate that force to the concrete 231 (see FIGS. 13-14B). Thus, the first and second end plates 216 and 218 directly transfer holdown forces (e.g., received from the holdown anchor 246) to the first and second concrete anchors 254A and 254B. The first and second concrete anchors 254A and 254B are responsible for transferring the holdown forces to the concrete 231 of the foundation system 233.

Referring to FIG. 10, the recesses R1-R6 may be formed (e.g., notched or cut) such that the tabs T1-T6 tightly fit within the recesses R1-R6, respectively. In other words, the upper stop walls USW and the lower stop walls LSW of the recesses R1-R6 may be configured to prevent the tabs T1-T6 from sliding vertically. Thus, the first and second end plates 216 tightly interact with the first and second side members 212 and 214. This close interaction allows holdown forces transferred to the first and second side members 212 and 214 (e.g., from the holdown anchor 246) to be directly transferred to the first and second end plates 216.

Referring to FIG. 13, the projections P1 and P2 and/or similar structures are configured and positioned to interact with the concrete 231 so the anchor track 210 and the concrete 231 act together or compositely to transfer holdown forces to the first and second end plates 216 and 218 (see FIGS. 9A-11B and 14A). Referring to FIG. 14A, together, the anchor track 210, the anchor assembly 232, and the first and second concrete anchors 254A and 254B form an assembly. The concrete 231 is configured to withstand greater compression forces than this assembly, which is configured to withstand greater tension stresses than the concrete 231. By combining the concrete 231 and the assembly, the resultant combination is able to withstand more compression and/or tension forces than the concrete 231 or the assembly would be able to withstand alone. For example, by utilizing the concrete 231 of the foundation system 233, the anchor track 210 may be constructed from a thinner steel plate than would be required if the concrete 231 was omitted, which reduces the cost of the anchor track 210.

FIG. 13 illustrates the anchor track 210 cast in the concrete 231. The concrete 231 is prevented from entering the channel 239 when the concrete 231 is poured, e.g., by a block insert, one or more other structures, or other means. For example, a block insert (not shown) like the block insert 33 (see FIG. 3) may be inserted into the upper opening 244 (see FIG. 11C) and extend through the channel 239 to prevent the concrete 231 from flowing into the channel 239. In other words, the block insert (not shown) may be configured to plug the upper opening 244 and the channel 239 to prevent the concrete 231 from entering therein. The block insert (not shown) can be removed after the concrete 131 has cured. However, as mentioned above, the anchor track 210 is not limited to use with the block insert (not shown) and alternate means may be used to prevent the concrete 231 from entering the channel 239.

Ductile failure is an important consideration in seismic design of buildings. The anchor track 210 may be fabricated at least in part out of steel, which has ductile characteristics that help compensate for the brittle nature of the concrete 231. Alternatively, the anchor track 210 may be constructed from materials other than steel. For example, the anchor track 210 may be constructed from plastic or composite materials, if the anchor track 210 is to be used for an application where the anchor track 210 would experience low seismic forces and low wind forces.

Referring to FIG. 14A, because the anchor assembly 232 is slidable longitudinally inside the anchor track 210, the anchor assembly 232 may be moved to a desired position adjacent the holdown anchor 246 after the anchor track 210 has been set in the concrete 231. Thus, the anchor assembly 232 may satisfy the load requirements of cast-in-place anchor bolts and, at the same time, provide the locational flexibility of post-installation anchors. In other words, the anchor assembly 232 may be placed in the correct location after the concrete 231 has cured.

Referring to FIG. 1B, the anchor track 10 may be easily transported to a building site after having been bent or as the sheet 43 (see FIG. 2). Referring to FIG. 5B, the anchor track 110 may be easily transported either assembled or as a pair of sheets each like the sheet 170 (see FIG. 6) along with the end plates 160A and 160B and rebar wires 156A and 156B. Referring to FIG. 9A, the anchor track 210 may be easily transported either assembled or as a pair of sheets each like the sheet 270 (see FIG. 12) along with the end plates 216 and 218. After being assembled and transported to the building site, each of the anchor tracks 10, 110, and 210 can be cast-in-place into concrete on site. Each of the anchor tracks 10, 110, and 210 allows the location of anchor bolt to be adjusted longitudinally and is capable of satisfying structural load requirements. Each of the anchor tracks 10, 110, and 210 may include projections, groove, divots, contours, and the like configured to interact with the hardened or cured concrete to increase tension strength of the anchor track.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

The invention claimed is:

1. An adjustable anchor system for use with a holdown anchor and at least one concrete anchor, the adjustable anchor system comprising:

an anchor track comprising at least one through-hole, a first side, a second side, a first end plate, and a second end plate, an upwardly opening channel defined between the first side, the second side, the first end plate, and the second end plate, each of the at least one through-hole being configured to receive a different one of the at least one concrete anchor, the first and second sides each extending longitudinally and comprising a first end with at least one longitudinally extending first tab and a second end with at least one longitudinally extending second tab, the first end plate comprising a plurality of spaced apart first recesses configured to receive the at least one longitudinally extending first tab of each of the first and second sides and couple the first end plate to the first and second sides with a central portion of the first end late positioned between the first and second sides the second end late comprising a plurality of spaced apart second recesses configured to receive the at least one longitudinally extending second tab of each of the first and second sides and couple the second end plate to the first and second sides with a central portion of the second end plate positioned between the first and second sides, the anchor track being configured to be at least partially embedded in concrete; and an anchor bolt assembly configured to removably couple the holdown anchor to the anchor track, the anchor bolt assembly being slidable within the upwardly opening channel between the first and second end plates to a desired position, the anchor bolt assembly extending upwardly from inside the upwardly opening channel to the holdown anchor and being couplable to the holdown anchor when the anchor bolt assembly is positioned adjacent to the holdown anchor.

2. The adjustable anchor system of claim 1 for use with the at least one concrete anchor comprising first and second concrete anchors, wherein the at least one through-hole comprises first and second through-holes formed in the first and second end plates, respectively, the first through-hole is configured to receive the first concrete anchor and allow the first concrete anchor to extend through the first through-hole inside the concrete; and the second through-hole is configured to receive the second concrete anchor and allow the second concrete anchor to extend through the second through-hole inside the concrete.

3. The adjustable anchor system of claim 1, wherein the first side has a first upper portion with a first flange formed in the first upper portion, the second side has a second upper portion with a second flange formed in the second upper portion, and the first and second flanges each extend outwardly away from the upwardly opening channel.

4. The adjustable anchor system of claim 1, wherein the anchor track has a bottom, the anchor bolt assembly is configured to receive holdown forces from the holdown anchor when coupled thereto and to transfer the holdown forces to the first and second sides, the first side comprises a first plurality of projections, groove, divots, or contours configured to help transfer the holdown forces to the concrete when the anchor track is at least partially embedded therein, the second side comprises a second plurality of projections, groove, divots, or contours configured to help transfer the holdown forces to the concrete when the anchor track is at least partially embedded therein, and the bottom comprises a third plurality of projections, groove, divots, or contours configured to help transfer the holdown forces to the concrete when the anchor track is at least partially embedded therein.

5. The adjustable anchor system of claim 1 for use with the at least one concrete anchor comprising first and second concrete anchors, wherein the first end plate has a first portion positioned below the first end of each of the first and second sides, the second end plate has a second portion positioned below the second end of each of the first and second sides, and the at least one through-hole comprises first and second through-holes formed in the first and second portions, respectively, and configured to receive the first and second concrete anchors, respectively.

6. The adjustable anchor system of claim 1 for use with the at least one concrete anchor comprising first and second concrete anchors, wherein the at least one through-hole comprises first and second through-holes formed in the first and second end plates, respectively, the first through-hole is configured to receive the first concrete anchor and allow the first concrete anchor to extend through the first through-hole inside the concrete, the second through-hole is configured to receive the second concrete anchor and allow the second concrete anchor to extend through the second through-hole inside the concrete, and the first and second end plates are configured to directly transfer forces received from the holdown anchor to the first and second concrete anchors, respectively, when the anchor bolt assembly is coupled to the holdown anchor.

7. The adjustable anchor system of claim 1, wherein the anchor bolt assembly is configured to receive holdown forces from the holdown anchor when coupled thereto and to transfer the holdown forces to the anchor track, and the anchor track is configured to transfer the holdown forces to the at least one concrete anchor, which transfers the holdown forces to the concrete.

8. The adjustable anchor system of claim 1 for use with the at least one concrete anchor comprising first and second bent sections of rebar, wherein the at least one through-hole comprises first and second through-holes, the first end plate has a first portion extending below the first end of the first and second sides, the second end plate has a second portion extending below the second end of the first and second sides, the first and second through-holes are formed in the first and second portions, respectively, the first through-hole is configured to receive the first bent section of rebar and allow the first bent section of rebar to extend therethrough and downwardly into the concrete; and the second through-hole is configured to receive the second bent section of rebar and allow the second bent section of rebar to extend therethrough and downwardly into the concrete.

9. The adjustable anchor system of claim 1, wherein the anchor track is constructed from steel, plastic, or a composite material.

10. An anchor track for use with an anchor assembly, a first concrete anchor, a second concrete anchor, and a holdown anchor, the anchor track comprising:

a first side comprising at least one first tab and at least one second tab that extend outwardly and longitudinally from opposite ends, respectively, of the first side;

a second side spaced apart from the first side to define a channel therebetween, the channel being configured to house a lower end portion of the anchor assembly therein, the channel having an upper opening configured to allow an upper end portion of the anchor assembly to extend therethrough and be coupled to the holdown anchor, the first and second sides being configured to receive holdown forces transmitted to the anchor assembly by the holdown anchor, the second side comprising at least one third tab and at least one fourth tab that extend outwardly and longitudinally from opposite ends, respectively, of the second side;

a first end portion extending between the first and second sides and closing a first end of the channel, the first end portion comprising a plurality of first recesses configured to receive the at least one first tab and the at least one third tab, the first end portion being configured to receive a first portion of the holdown forces from the first and second sides, the first end portion being connectable to the first concrete anchor when the first concrete anchor is extending downwardly below the anchor track, the first end portion being configured to transfer the first portion of the holdown forces to the first concrete anchor; and a second end portion extending between the first and second sides and closing a second end of the channel, the second end portion comprising a plurality of second recesses configured to receive the at least one second tab and the at least one fourth tab, the anchor assembly being slidable within the channel between the first and second ends to a position adjacent the holdown anchor when the first concrete anchor, the second concrete anchor, and lower portions of the first side, the second side, the first end portion, and the second end portion are embedded in fully cured concrete, the second end portion being configured to receive a second portion of the holdown forces from the first and second sides, the second end portion being connectable to the second concrete anchor when the second concrete anchor is extending downwardly below the anchor track, the second end portion being configured to transfer the second portion of the holdown forces to the second concrete anchor.

11. The anchor track of claim 10, wherein the first end portion is a first plate that extends between the first and second sides and closes the first end of the channel, and the second end portion is a second plate that extends between the first and second sides and closes the second end of the channel.

12. The anchor track of claim 11, wherein the lower portion of the first plate comprises a first through-hole configured to allow the first concrete anchor to pass therethrough, and the lower portion of the second plate comprises a second through-hole configured to allow the second concrete anchor to pass therethrough.

13. The anchor track of claim 10, wherein the first side comprises a first ledge portion and a first base portion, the second side comprises a second ledge portion and a second base portion, the first and second base portions extend toward one another and close a bottom portion of the channel, the channel has an upper channel portion positioned between the upper opening and the first and second ledge portions, the channel has a lower channel portion positioned under the first and second ledge portions and above the first and second base portions, the lower channel portion being wider than the upper channel portion, and the first and second ledge portions being configured to prevent the lower end portion of the anchor assembly from exiting the lower channel portion.

14. A method comprising:

attaching at least one concrete anchor to an anchor track with the at least one concrete anchor extending downwardly below the anchor track, the anchor track comprising a first side, a second side, a first end plate, and a second end plate, a longitudinally extending channel being defined between the first side, the second side, the first end plate, and the second end plate, the first and second sides each extending longitudinally and comprising a first end with at least one longitudinally extending first tab and a second end with at least one longitudinally extending second tab, the first end plate comprising a plurality of spaced apart first recesses configured to receive the at least one longitudinally extending first tab of each of the first and second sides and couple the first end plate to the first and second sides with a central portion of the first end plate positioned between the first and second sides, the second end plate comprising a plurality of spaced apart second recesses configured to receive the at least one longitudinally extending second tab of each of the first and second sides and couple the second end plate to the first and second sides with a central portion of the second end plate positioned between the first and second sides;

attaching an anchor assembly to the anchor track inside the longitudinally extending channel;

embedding the at least one concrete anchor and at least a lower portion of the anchor track in concrete;

sliding the anchor assembly within the longitudinally extending channel to a location adjacent a holdown anchor after the concrete has cured; and coupling the anchor assembly to the holdown anchor.

15. The method of claim 14, further comprising:

pouring the concrete around the anchor track; and inserting a block insert into the longitudinally extending channel before pouring the concrete, the block insert being configured to prevent the concrete from entering the longitudinally extending channel.

16. The method of claim 14, further comprising constructing the anchor track by:

bending a first flat sheet to form the first side of the anchor track;

bending a second flat sheet to form the second side of the anchor track;

coupling the first and second sides together with the first end plate; and coupling the first and second sides together with the second end plate.

17. The method of claim 16, wherein constructing the anchor track further comprises:

forming a first flange in an upper portion of the first side, the first flange extending outwardly away from an upper opening of the longitudinally extending channel; and forming a second flange in an upper portion of the second side, the second flange extending outwardly away from the upper opening of the longitudinally extending channel.

18. The method of claim 14, wherein the at least one concrete anchor comprises first and second concrete anchors, and attaching the at least one concrete anchor to the anchor track further comprises:

inserting the first concrete anchor in a first through-hole formed in the first end plate, the first through-hole being positioned below the first end of each of the first and second sides, the first concrete anchor comprising a bend such that a portion of the first concrete anchor extends downwardly below the anchor track; and inserting the second concrete anchor in a second through-hole formed in the second end plate, the second through-hole being positioned below the second end of each of the first and second sides, the second concrete anchor comprising a bend such that a portion of the second concrete anchor extends downwardly below the anchor track.

19. An anchor track for use with an anchor assembly, a first concrete anchor, a second concrete anchor, and a holdown anchor, the anchor track comprising:

a front side comprising at least one first tab and at least one second tab that extend outwardly and longitudinally from opposite ends, respectively, of the front side;

a rear side spaced apart from the front side to define a channel therebetween, the rear side comprising at least one third tab and at least one fourth tab that extend outwardly and longitudinally from opposite ends, respectively, of the rear side, the channel comprising an upper channel portion and a lower channel portion, the lower channel portion being wider than the upper channel portion, the lower channel portion being configured to house a lower end portion of the anchor assembly, the front and rear sides being configured to prevent the lower end portion from entering the upper channel portion thereby trapping the lower end portion inside the lower channel portion, the upper channel portion having an upper opening configured to allow an upper end portion of the anchor assembly to extend therethrough and be coupled to the holdown anchor, the front and rear sides being configured to receive holdown forces transmitted to the anchor assembly by the holdown anchor;

a first end portion extending between the front and rear sides and at least partially closing a first end of the lower channel portion, the first end portion comprising a first concrete anchor receiving portion and a plurality of first recesses, the plurality of first recesses being configured to receive the at least one first tab and the at least one third tab, the first concrete anchor receiving portion being configured to receive the first concrete anchor when the first concrete anchor is extending downwardly below the anchor track; and a second end portion extending between the front and rear sides and at least partially closing a second end of the lower channel portion, the second end portion comprising a second concrete anchor receiving portion and a plurality of second recesses, the plurality of second recesses being configured to receive the at least one second tab and the at least one fourth tab, the anchor assembly being slidable within the lower channel portion between the first and second ends of the lower channel portion to a position adjacent the holdown anchor when the anchor track is at least partially embedded in fully cured concrete, the second concrete anchor receiving portion being configured to receive the second concrete anchor when the second concrete anchor is extending downwardly below the anchor track.

20. The anchor track of claim 19, wherein the front and rear sides each comprise a first plurality of projections, groove, divots, or contours to interact with the fully cured concrete to increase tension strength of the anchor track and help transfer the holdown forces to the fully cured concrete when the anchor track is at least partially embedded therein.

21. The anchor track of claim 20, further comprising:

a base wall comprising a second plurality of projections, groove, divots, or contours to interact with the fully cured concrete to increase tension strength of the anchor track and help transfer the holdown forces to the fully cured concrete when the anchor track is at least partially embedded therein.

22. The anchor track of claim 19, further comprising:

a base wall comprising a plurality of projections, groove, divots, or contours to interact with the fully cured concrete to increase tension strength of the anchor track and help transfer the holdown forces to the fully cured concrete when the anchor track is at least partially embedded therein.

23. The anchor track of claim 19, wherein the front side has a first upper portion with a first flange formed in the first upper portion, the rear side has a second upper portion with a second flange formed in the second upper portion, and the first and second flanges each extend outwardly away from the upper opening of the channel.

24. The anchor track of claim 19, being at least partially embeddable in fully cured concrete forming part of a foundation of a building, and the anchor track being configured to couple a structure to the foundation when the lower channel portion houses the lower end portion of the anchor assembly, the upper end portion of the anchor assembly is coupled to the holdown anchor, and the holdown anchor is coupled to the structure.

* * * * *